US008007174B2

(12) United States Patent
Yamaguchi et al.

(10) Patent No.: US 8,007,174 B2
(45) Date of Patent: Aug. 30, 2011

(54) BAG-LIKE CONTAINER WITH SPOUT

(75) Inventors: Madoka Yamaguchi, Toyohashi (JP); Masahiro Akioka, Tokyo (JP); Mutsushi Hirano, Tokyo (JP); Kenji Yoshihiro, Yokohama (JP); Takashi Miura, Yokohama (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 999 days.

(21) Appl. No.: 11/793,519

(22) PCT Filed: Jun. 6, 2005

(86) PCT No.: PCT/JP2005/010740

§ 371 (c)(1),
(2), (4) Date: Oct. 4, 2007

(87) PCT Pub. No.: WO2006/067880

PCT Pub. Date: Jun. 29, 2006

(65) Prior Publication Data

US 2008/0124006 A1 May 29, 2008

(30) Foreign Application Priority Data

Dec. 20, 2004 (JP) ..... 2004-368215

(51) Int. Cl.

| | |
|---|---|
| ***B65D 33/10*** | (2006.01) |
| ***B65D 33/00*** | (2006.01) |
| ***B65D 33/16*** | (2006.01) |
| ***B65D 30/16*** | (2006.01) |

(52) U.S. Cl. ..... 383/9; 383/41; 383/61.2; 383/63; 383/104; 383/906

(58) Field of Classification Search ..... 383/61.2, 383/63, 104, 203, 204, 41, 116, 80, 9, 906
See application file for complete search history.

(56) References Cited

U.S. PATENT DOCUMENTS 4,869,725 A * 9/1989 Schneider et al. ..... 604/408
4,925,316 A * 5/1990 Van Erden et al. ..... 383/210.1
5,709,467 A * 1/1998 Galliano, II ..... 366/130
(Continued)

FOREIGN PATENT DOCUMENTS

JP 2000-006999 A 1/2000
(Continued)

OTHER PUBLICATIONS

International Search Report of PCT/JP2005/010740, date of mailing Sep. 13, 2005.

*Primary Examiner* — Jes F Pascua
(74) *Attorney, Agent, or Firm* — Westerman, Hattori, Daniels & Adrian, LLP

(57) ABSTRACT

A bag-like container with a spout in which a plastic linear fastener is interposed in an upper part of the container so that when water content or the like is to be supplied after contents of a liquid food container or the like have been administered to a subject, opening and closing the linear fastener enables the water content or the like to be supplied in an uncomplicated manner without the use of a separate member such as a spout that is an open part for pouring food, water, or the like into the container.

14 Claims, 21 Drawing Sheets

U.S. PATENT DOCUMENTS

| | | | | |
|---|---|---|---|---|
| 6,499,878 | B1 * | 12/2002 | Dobreski et al. | 383/5 |
| 6,820,395 | B2 * | 11/2004 | Ausnit | 53/412 |
| 6,913,387 | B2 * | 7/2005 | Strand et al. | 383/61.2 |
| 7,055,720 | B1 * | 6/2006 | Pritchard | 222/107 |
| 7,416,336 | B2 * | 8/2008 | Linton et al. | 383/5 |
| 2003/0002753 | A1 * | 1/2003 | Stolmeier et al. | 383/64 |
| 2004/0131283 | A1 * | 7/2004 | Sprague et al. | 383/61.2 |
| 2008/0233252 | A1 * | 9/2008 | Manning et al. | 426/412 |

FOREIGN PATENT DOCUMENTS

| | | | |
|---|---|---|---|
| JP | 2000-007033 | A | 1/2000 |
| JP | 2000-152975 | A | 6/2000 |

* cited by examiner

PRIOR ART

PRIOR ART

PRIOR ART

BAG-LIKE CONTAINER WITH SPOUT

TECHNICAL FIELD

The present invention relates to a bag-like container with a spout for, e.g., a container for administering enteral nutrients, liquid food, or the like, or a so-called pouch for liquid food. More specifically, the present invention relates to a bag-like container with a spout in which a plastic linear fastener is interposed on an upper edge part. Water content or the like can be supplied in an uncomplicated manner by opening and closing the linear fastener when water content or the like is to be supplied after contents of a container have been administered to a subject. A separate member, such as a spout for pouring water content or the like into the container, is not used.

BACKGROUND ART

[Prior Art Document 1] Japanese Laid-open Patent Application Publication No. 2000-7033

[Prior Art Document 2] Japanese Laid-open Patent Application Publication No. 2000-6999

[Prior Art Document 3] Japanese Laid-open Patent Application Publication No. 2000-152975

Prior Art Document 1 discloses a so-called pouch for liquid food, which is a tube enteral nutrient pouch a in which a peripheral edge part e of a film having a heat sealing synthetic resin in an inner layer is heat-sealed; a pouring-out member b is attached to an edge of the pouch, and a pouring-in member c having a lid member is attached to an edge opposite this edge, as shown in FIG. 27. Holes (suspending means) d used to suspend the pouch for liquid food are formed on an upper part e1 and lower part e2 of the peripheral edge part e. A hole d2 formed on a lower peripheral edge part e2 is used to hang the pouch on a suspending implement (not shown) when a spout of the pouring-out member b is cut open and a contents supplying pipe is attached. When the contents of the pouch for liquid food are administered to a subject, a hole d1 or d3 formed on an upper peripheral edge part e1 is used to hang the pouch on the suspending implement.

Prior Art Document 2 relates to a nutrient pouch used for the same purpose as Prior Art Document 1. The pouch of Prior Art Document 2 is characterized in that a filling implement c for pouring in a filling material is provided to one edge part of a main body of a hangable pouch for liquid food a that formed from flexible sheet pieces; a pouring-out implement b for pouring out the filling material is provided to the other edge part; and a pouring inlet c for the filling implement is formed at a size that is larger than the spout b of the pouring implement, as shown in FIG. 28. In the pouch for liquid food, one side edge part is used as a gusset f and a bottomed pouch for liquid food is formed by tucking the gusset inward; and another side edge part is heat sealed without forming a gusset. Accordingly, the part forming the gusset can be positioned as a bottom part when the pouch for liquid food is transported, and stable transport can be achieved.

Prior Art Document 3 is configured so that a lower part of a pouch for liquid food a is a contents spout, as shown in FIG. 29. Therefore, the area around a distal end part is torn using a cut part g2 to form a spout b.

When water content is supplied after the contents have been poured out, part of the pouch body is cut using a cut part g1 that is above the pouch for liquid food. The pouch is then sealed by a zipper-type openable and closeable sealing part h.

In both of the pouches for liquid food disclosed in Prior Art Documents 1 and 2, a pouring inlet (filling implement) that is a separate member and that is larger than the spout must be specially provided as means for supplying water content or the like once the contents of the pouch have been administered.

Prior Art Document 3 is convenient in that part of the pouch is torn and an opening is formed without the use of a separate filling implement as the means for supplying water content. A zipper-type sealing implement is used for the sealing structure of this portion.

DISCLOSURE OF THE INVENTION

However, problems exist in Prior Art Documents 1 and 2 in that separate spouts are built onto part of the pouch not only for the pouring-out spout, but also for supplying water content and the like. This not only makes the manufacturing process complicated, but also increases costs and is uneconomical as a one-way pouch for liquid food. Furthermore, under certain circumstances, the pouch cannot be disposed of after being used. Therefore, the pouch must be specially separated and disposed of, and an inordinate amount of time is required to dispose of the pouch.

As in Prior Art Document 3, providing means for tearing part of the pouch to form an opening is convenient and extremely economical. However, the contents of the pouch for liquid food always comes into contact with the portion of the zipper used to form a seal after the pouch is opened. Therefore, liquid inside may pass over a fitting part of the zipper before unsealing and reach the unsealed part. In such instances, during unsealing, the liquid will splatter or the fingers of a person will come into contact with the liquid when the zipper is open, which is unsanitary. In addition, when the pouch is resealed using the sealing implement, there is a risk that foreign materials will adhere to a portion of the sealing implement or that contaminants will enter, which is not preferable in terms of hygiene.

In view of the circumstances of the prior art, it is an object of the present invention to provide a bag-like container with a spout for a pouch for liquid food or the like in which a separately provided spout is not used; unnecessary procedures, such as specially using a sealing implement to seal an open part after unsealing, are not required; and food, water, and the like can be supplied and resealing can be performed in an uncomplicated manner and in a clean state, in which foreign materials and contaminants are prevented from entering as much as possible, by using a specified sealing implement to form an open part and seal the opening.

It is another object of the present invention to provide a bag-like container with a spout in which instances of splitting when a suspending part and a predicted unsealing part are folded and bent in different directions are avoided even when the suspending part and predicted unsealing part are separate by a cut part.

It is yet another object of the present invention to provide a bottomed bag-like container with a spout that can stably be placed in a wagon or the like during transport or movement; and in which instances of the clothing or bedding of a subject becoming wet are avoided during an operation for adding water into the container.

Further objects of the present invention shall be made clear from the below description.

The present invention is provided in order to achieve the above-described objects, and, generally speaking, consists of three inventions composed of the requirements set forth in the first invention, the second invention and the third invention as described below.

<First Invention>

According to a first invention of the present application, there is provided a bag-like container with a spout in which a peripheral edge part of a body member formed from front and rear plastic films is sealed, and in which a contents spout is formed at a part of the peripheral edge part; the bag-like container with a spout characterized in that an openable and closeable plastic linear fastener is fused to near the peripheral edge part of the container set apart from the contents spout with its both ends connected to the peripheral edge part of the container so that an internal space of the container is divided into a side on which the contents spout is present and a predicted unsealing part side;

a linear projecting part is formed on one surface in the linear fastener and a recessed part that engages with the projecting part is formed on a surface facing the linear projecting part in the linear fastener; and the projecting part and recessed part of the linear fastener are cut off in a liquid-tight manner from the internal space of the container having the contents spout through a film having a weakened part.

<Second Invention>

According to a second invention of the present application, there is provided a bag-like container with a spout in which a peripheral edge part of a body member formed from front and rear plastic films is sealed, and in which a contents spout is formed at a part of the peripheral edge part; the bag-like container with a spout characterized in comprising:

a suspending part that is formed on a side opposite the contents spout and that is suspended by a suspending implement;

a supplying part that is adjacent to the suspending part and that forms a supply opening in accordance with the unsealing of a predicted unsealing part;

a cut part formed between the suspending part and the supplying part; and a connecting part that is formed in the cut part and that is used to partially connect the suspending part and the supplying part.

<Third Invention>

According to a third invention of the present application, there is provided a bottomed bag-like container with a spout in which peripheral edge parts of a plurality of polygonal plastic films forming a front surface, rear surface, and bottom surface are sealed, and a contents pouring implement is attached to part of the peripheral edge part; the bottomed bag-like container with a spout characterized in that a gripping part is formed on a peripheral edge part of the container set apart from the contents pouring implement; an openable and closeable plastic linear fastener, in which a linear projecting part is formed on one surface and a recessed part that engages with the projecting part is formed on a surface opposite the projecting part, is formed across the gripping part at a location set apart toward the inside of the container from an outer-end sealed part in the gripping part.

BEST MODE FOR CARRYING OUT THE INVENTION

Best embodiments of the present invention shall be described below with reference to the drawings.

<First Invention>

Figure 1:
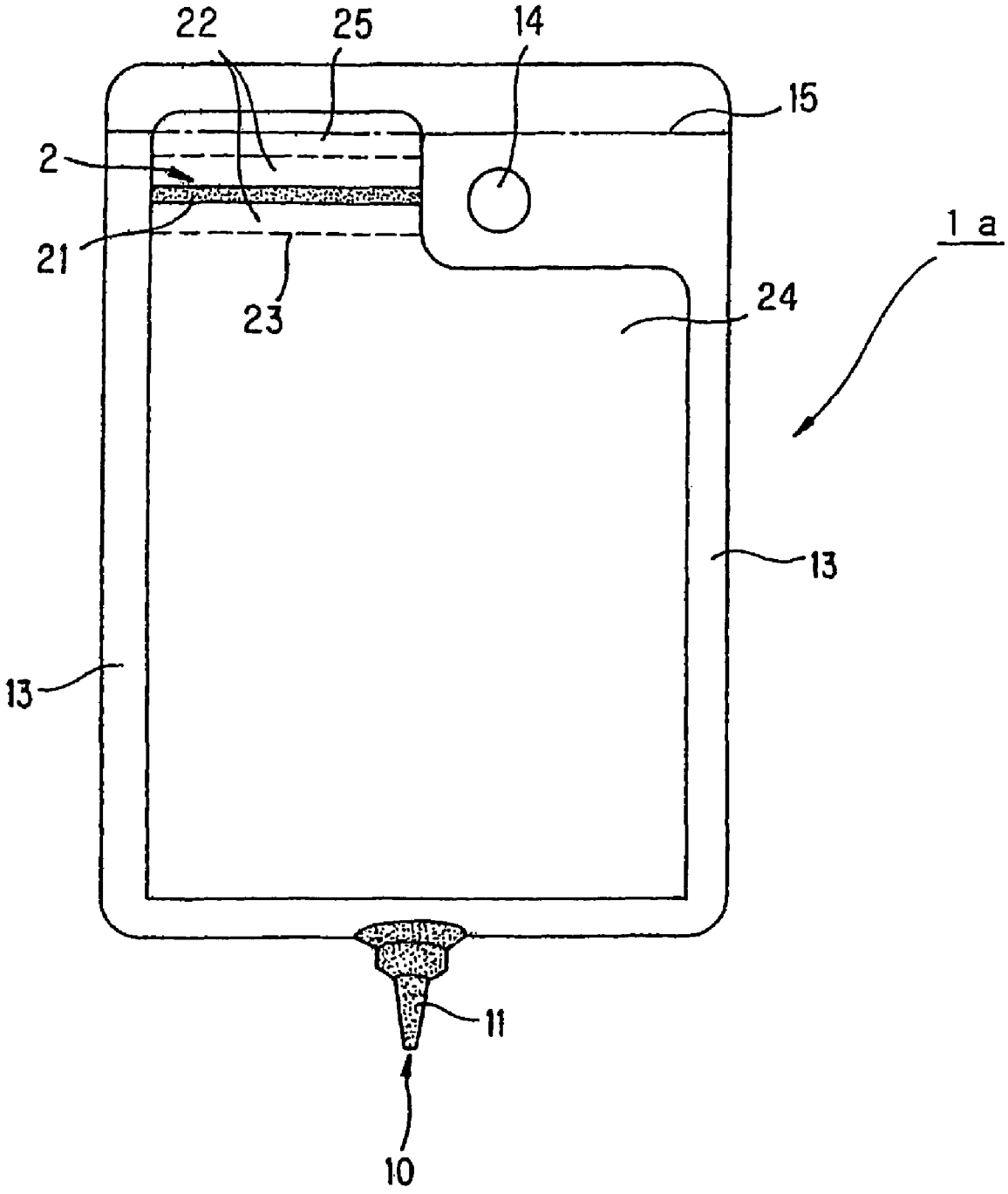
FIG. 1 is a front view showing a preferred configuration of a bag-like container with a spout of a first invention of the present application.
Figure 8:
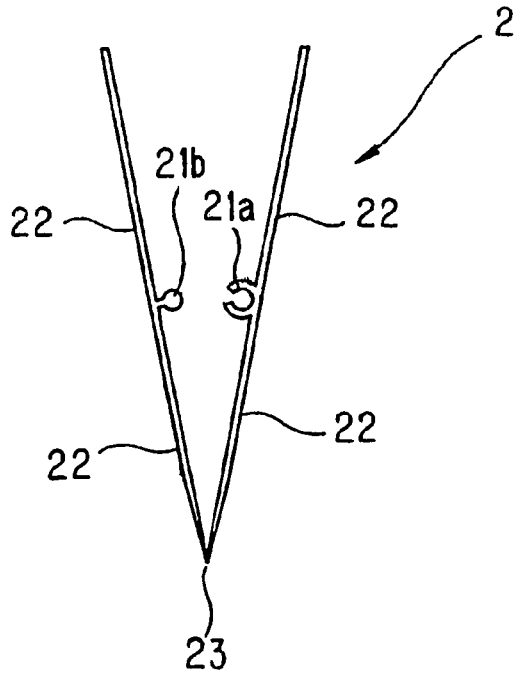
FIG. 8 is an enlarged cross-sectional view of a linear fastener.
Figure 9:
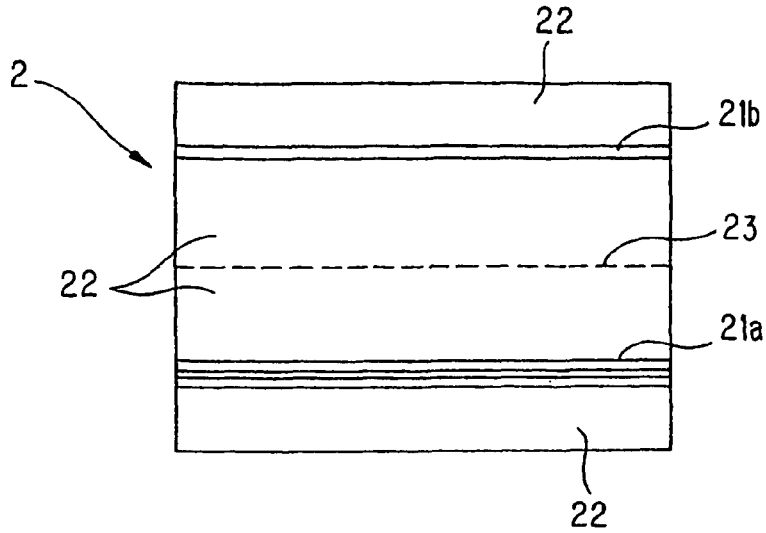
FIG. 9 is a plan view of a state in which the linear fastener of FIG. 8 has been opened.
Figure 10:
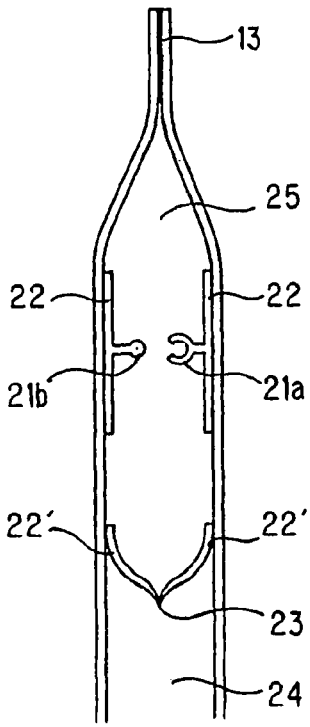
FIG. 10 is a partial cross-sectional view in which the linear fastener and a weakened part are formed by separate members.
Figure 11:
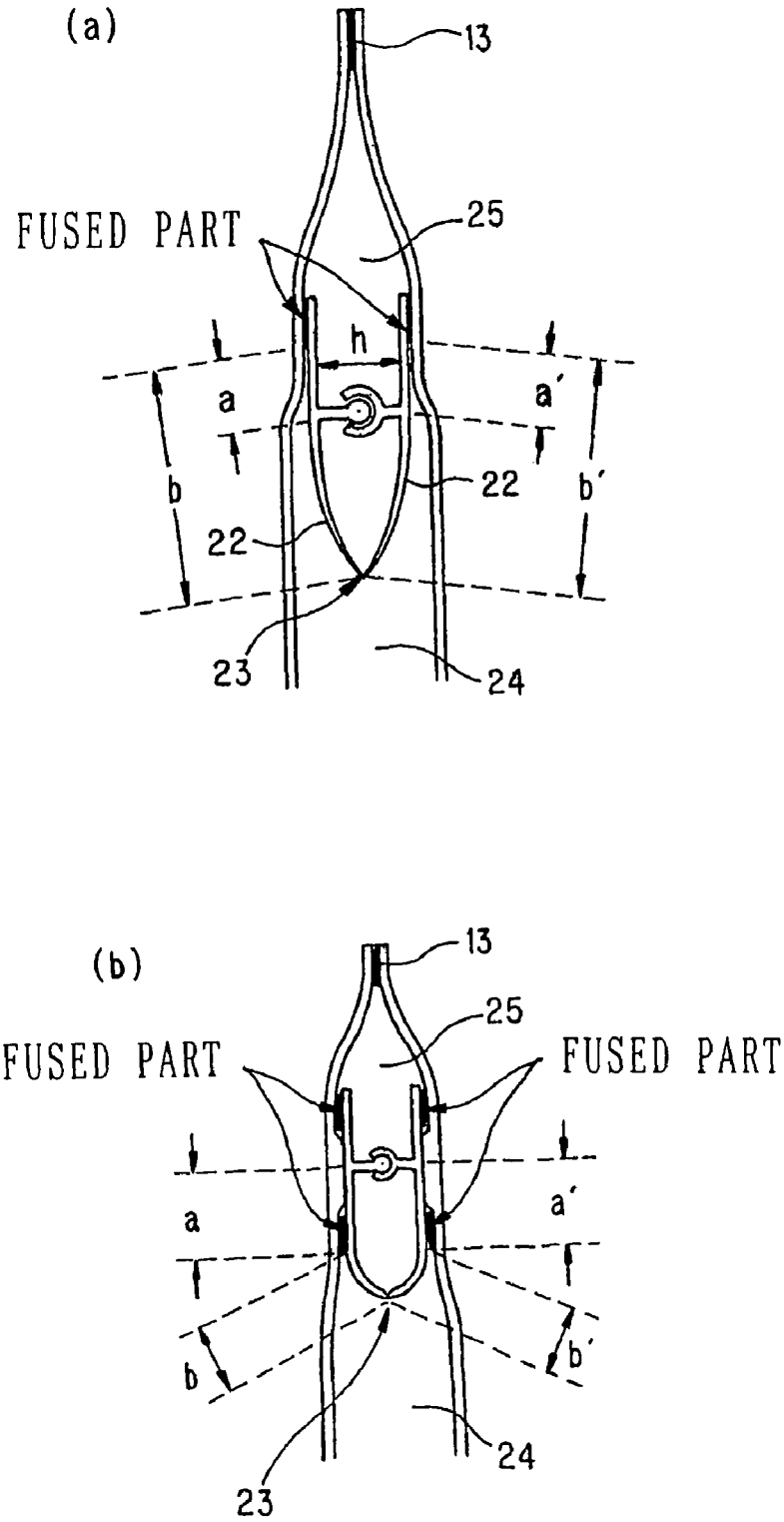
FIG. 11 is a partial cross-sectional view showing a state of fusion of the linear fastener and a body of the container.

FIG. 1 is a descriptive view showing an embodiment of a bag-like container with a spout 1. FIGS. 2 through 7 are descriptive views showing other embodiments of a bag-like container with a spout. FIG. 8 is an expanded view of a cross-sectional structure of a plastic linear fastener of a liquid food container that is a preferred application for the bag-like container with a spout. FIG. 9 is a plan view of the linear fastener. FIG. 10 is a schematic view showing, in a cross-sectional view, a mode in which a film having a linear fastener and a weakened part is formed from separate members. FIG. 11 is a perspective view showing, in cross-sectional views of (a) and (b), differing states of fusion of the linear fastener and an inner surface of the container.

Generally speaking, in the bag-like container with a spout 1 (referred to below simply as "container") of the present invention, a peripheral edge part 13 of a body member composed of polygonal plastic films constituting a front and rear is sealed, and a contents pouring-out implement 11 having a spout 10 is attached to part of the peripheral edge part. A plastic linear fastener 2 is fused to an inner side near the peripheral edge part of the container apart from the contents pouring-out implement 11. A predicted unsealing part 15 is provided between the linear fastener 2 and a sealed part 13. The predicted unsealing part 15 is a portion that is unsealed using scissors, a knife, or another cutting implement when the linear fastener 2 is to be used. The portion may also be formed as a weakened part in which, e.g., scoring is provided so as to enable the portion to be unsealed by hand without the use of a cutting implement. Alternatively, a notch or other cut may be made at an unsealing starting part. The peripheral edge part of the container is preferably sealed by heat sealing, but may also be sealed by ultrasonic sealing.

No particular limitation is placed on the shape of the bag-like container with a spout of the present invention. However, as in the patent documents and FIGS. 1 through 7 of the specification of the present application, an irregular polygonal shape, with a quadrangular shape being the basic shape, is generally often used. Corner parts of the polygonal shape need not be sharply angular, and a shape may be adopted in which the straight lines are connected by a curved line. Any shape may be used as long as the shape is approximately polygonal when viewed as a whole. The plastic film constituting the body of the bag-like container with a spout 1 is preferably transparent so that the condition of the administration of the contents can be checked from the outside. The plastic film may be a singular film. However, a composite film having two or more layers is normally used.

The plastic film seals the peripheral edge part. Therefore, when sealing is performed by heat sealing, an inner layer must be composed of a plastic that can be heat sealed even when a composite film is used. A laminate film composed of a heat seal layer (inner layer)/barrier layer (intermediate layer)/surface layer (outer layer) or a heat seal layer (inner layer)/base material layer (intermediate layer)/barrier layer (intermediate layer)/surface layer (outer layer) is preferably used. Specifically, the use of a laminate film in which the inner layer is polypropylene, the intermediate layer is nylon, and the outer layer is polyethylene terephthalate formed by vapor-deposited aluminum oxide, inorganic silicon, or another thin film as a barrier layer on the inner layer side will result in excellent gas barrier qualities, resistance to penetration, and transparency.

In this instance, the intermediate layer functions as a barrier layer for preventing deterioration and decay in the contents. In addition to nylon or a vapor-deposited layer, an ethylene-vinyl alcohol copolymer resin film (EVOH) or the like may be used for the intermediate layer. In addition to polypropylene, polyethylene or the like may be used for the inner layer. In addition to polyethylene terephthalate, nylon or the like may be used for the outer layer.

A spout formed from polypropylene resin or another generally hard plastic that is suitably able to withstand retort processes, or known pouring implements disclosed in the above-described patent documents can be used for the contents pouring-out implement 11 of the bag-like container with a spout 1 of the present invention. The pouring implement is attached to the peripheral edge part of the plastic film constituting the body of the liquid food container in a state of being fused between the inner layers of the plastic film. Therefore, the pouring implement must be composed of a material that can be fused with the inner layers of the film constituting the container. However, a distal end part of the pouring implement may be given a tapered shape so as to facilitate insertion into a pipe for discharging the contents, and an outer periphery of the distal end part may be formed into an irregular shape or another suitable arbitrary step may be taken in order to make the pipe less likely to fall out. The spout of the bag-like container with a spout of the present invention is preferable in that the container is formed by fusing a separate contents pouring-out implement comprising a discharge nozzle to the body member of the container, and in that the attachment of a tube and other tasks relating to pouring out the contents are readily performed. However, a configuration may also be adopted in which the body member of the container is formed into a nozzle shape and used as the spout without attaching the separately provided contents pouring implement.

In the plastic linear fastener 2 of the present invention, a facing pair of film-like base materials 22, 22 are attached, a linear projecting part 21*b* is formed on one surface in a longitudinal direction, and a recessed part 21*a* that engages with the projecting part is formed on a surface facing the projecting part, as shown in FIGS. 8 and 9. Therefore, the linear fastener itself is known as, e.g., "Ziploc" (trademark), which is used to reseal a pouch for food products after the pouch has been unsealed. It is important to note that, in the present invention, the projecting part 21*b* and recessed part 21*a* of the linear fastener 2 are cut off, liquid-tight, from an open space 24 inside the container having the contents spout 10 by a film having a weakened part 23. The film having the weakened part may be formed by a film 22' that is separate from the linear fastener 2, as shown in FIG. 10. However, using the film-like base material 22 of the linear fastener 2 will result in fewer members, and is therefore preferable. It is also important to note that, in this instance, sides of the two film-like base materials 22 to which are attached the projecting part 21*b* and recessed part 21*a* of the linear fastener 2 facing the inside of the container (a side opposite the side of the predicted unsealing part) are extended and the film-like base materials 22 are mutually connected through the weakened part 23.

In this configuration, the portions extending toward the side of the film-like base materials 22 of the linear fastener facing the inside of the container are connected through a weakened part 23, whereby the contents of the container are prevented from coming into contact with the projecting part and recessed part of the linear fastener 2, i.e., the engaging part itself, merely by having the contents of the container come into contact with a surface on the side opposite the surface formed by the projecting part and recessed part of the film-like base materials 22. Therefore, the contents of the container do not adhere to the engaging part of the linear fastener 2 and the area around the engaging part. Even if the predicted unsealing part 15 on the outside of the linear fastener in a liquid food container or the like is unsealed after the contents are administered, and a portion of the linear fastener 2 comes into contact with outside air, instances of foreign materials and contaminants entering in due to the contents adhering to this portion can be prevented ahead of time. A function as a supplying part 15*a* can also be exhibited, whereby water or the like is added from the portion of the sealed linear fastener in a clean state.

The weakened part of the linear fastener should maintain a connected state that will not break while the contents are in the container and will break following the unsealing of the linear fastener, and can readily be formed by, for example, making the aforementioned portion thin or by forming scoring. The linear fastener must be able to be thermally adhered to the inner surface of the container and must be suitably able to withstand retort processes when the contents are sterilized. The linear fastener is formed by, e.g., extrusion molding using polypropylene resin or the like. The weakened part can be formed at that time by forming a portion thinner than other parts of the film-like base materials. A multi-layered structure having two or more layers may also be adopted in which different resins are used for the surfaces of the fastener on which the projecting part and recessed part are formed and for the sealed surface of the fastener in order to enhance thermal adhesion.

The linear fastener 2 is fused to the body member of the container by fusing the film-like base materials 22 of the linear fastener and the body member film of the inner surface of the container using heat or ultrasonic waves. The space inside the container is divided and the contents and engaging parts of the fastener are kept from coming into contact with one another. Therefore, both end parts of the linear fastener must be sealed. Preferably, both of the end parts are connected to the sealed part of the peripheral edge part of the container and are sealed. An example of a mode in which the body of the container and the film-like base materials are fused is schematically shown in FIGS. 11(*a*) and 11(*b*). As shown in FIG. 11(*a*), when a relationship is established such that $$a+a'+h<b+b'$$

where a, a' are the lengths of the film between the projecting part and recessed part and the fused part nearest to the weakened part, respectively; b, b' are the lengths between the weakened part 23 and the fused parts, respectively; and h is the height when the projecting part and recessed part are engaged; fusing the members along the linear projecting part and recessed part will result in a configuration in which the weakened part will break after the linear fastener is disengaged, which is preferable.

Fusion between the body of the container and the film-like base materials can be achieved without fusing the film-like base materials on the side of the projecting part and recessed part near the weakened part, as shown in FIG. 11(*a*), or can be achieved by fusing the film-like base materials on both sides of the projecting part and recessed part with the body of the container, as shown in FIG. 11(*b*). However, preferably, in addition to both ends of the linear fastener, the film-like base material on the side opposite the side where the weakened part is situated in relation to the linear projecting part and recessed part is fused with the body of the container along the projecting part and recessed part, and part of the portion of the film-like base material nearer to the weakened part than the projecting part and recessed part is not fused with the film of the body member of the container, as shown in FIG. 11(*a*). This enables the fusing operation to be more readily performed, and is therefore preferable.

Figure 2:
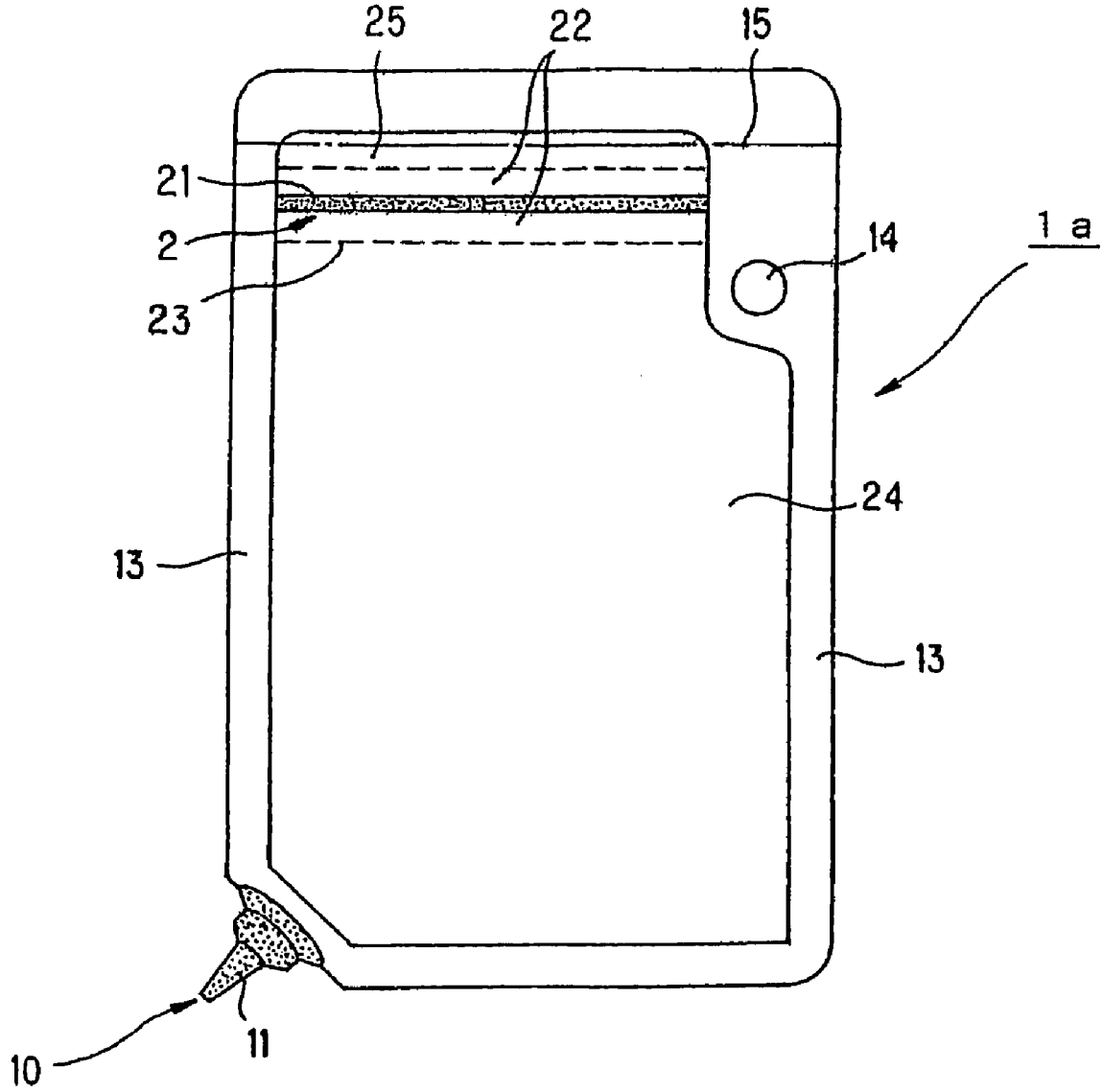
FIGS. 2 through 7 are front views showing other configurations of the first invention.

The side of the linear fastener on the outer end of the container may be sealed by the peripheral edge part of the container in an unsealable state. However, in general, the outer end of the container is preferably sealed in the same manner as the other peripheral edges of the container in a state in which the outer end part of the linear fastener is also positioned on the inside of the container and covered by the body member of the container. In this instance, unsealing scoring or the like may be formed between the linear fastener and the sealed part of the peripheral edge of the container on the outer end side of the linear fastener. No particular limitation is placed on the position at which the contents pouring-out implement 11 is attached. However, it is generally preferable for the contents pouring-out implement to be positioned at the lower peripheral edge of the container, as shown in FIG. 1, or at any of the corner parts of the container, as shown in FIG. 2.

The contents pouring-out implement 11 and linear fastener should be set apart from each other. No particular limitation is placed on the locations at which the contents pouring-out implement and linear fastener are formed. However, when the pouring-out implement 11 faces downward and the container is suspended, water will more readily fill from the opening if the fastener is positioned above the center of the container. In general, the bag-like container with a spout of the present invention is used while hung on, for example, a hook-shaped suspending implement (not shown). In such instances, suspending means 14 must be formed on at least a side of the container that is opposite the side on which the contents pouring-out implement is attached.

A hole is most commonly formed at a predetermined position on the peripheral edge part (sealed part) 13 as the suspending means 14. However, a cut that allows the suspending implement to enter may be formed instead of a perfect hole. The suspending means 14 is typically provided to the sealed part of the container that faces a position at which the contents pouring-out implement 11 is attached. However, the suspending means is used not only when the contents of the container with a spout are poured out. For example, in a configuration such as that of FIG. 1, the suspending means is formed on the side on which the contents pouring-out implement is attached, whereby the suspending means can be used during operations such as connecting a pipe to the contents pouring-out implement during preparation before, e.g., the liquid food container is administered.

Figure 3:
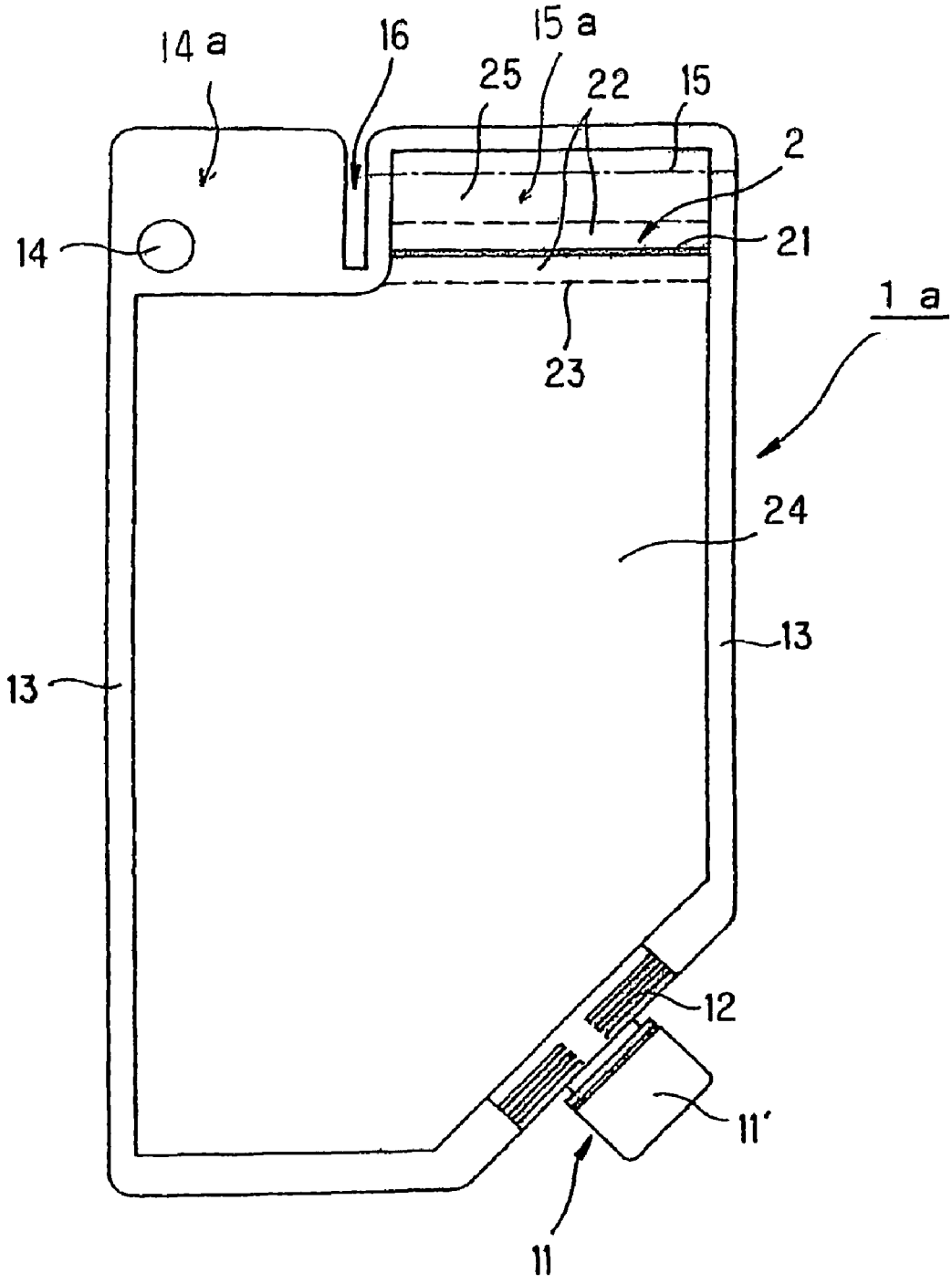

The configurations shown in FIGS. 3 through 7 are other modes of the first invention. In the mode of FIG. 3, a sealed part on which the suspending means 14 is formed and a portion where the linear fastener is sealed are separated by a cut 16, and the operation for unsealing the linear fastener 2 portion can be performed independently from the suspending means 14. A cap 11' can also be placed on the contents pouring-out implement 11, enabling the pouch to be finger access part in a more sanitary manner.

Figure 4:
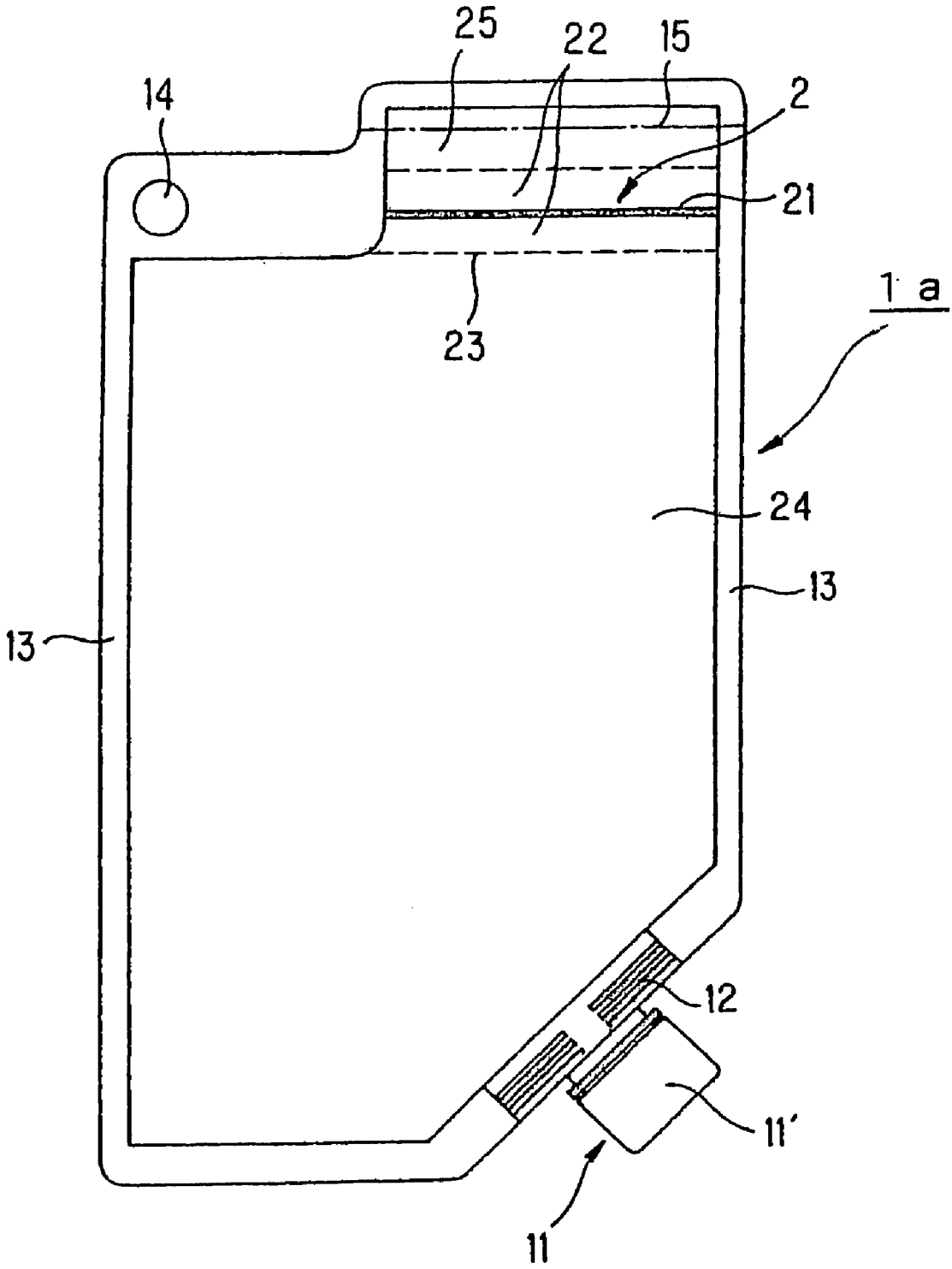
Figure 5:
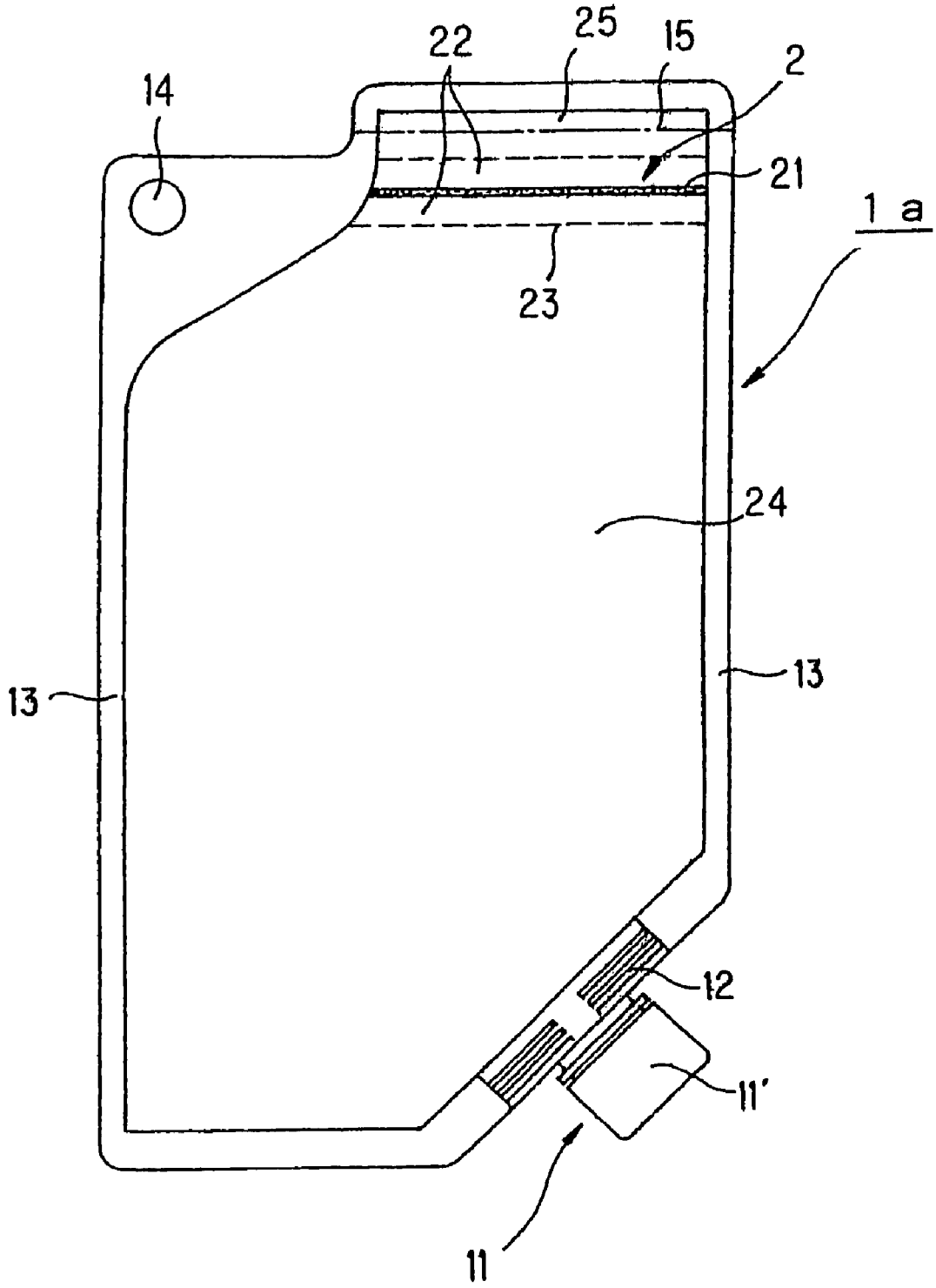

The mode of FIGS. 4 and 5 is characterized in that the predicted unsealing part 15 is formed protruding further outward than the sealed part where the suspending means 14 is formed, and in that the sealed part on which the suspending means 14 is formed faces the contents pouring-out implement 11 provided to a heat sealed part in which opposing lower corner parts have been diagonally cut, so that a suspended container will be kept properly balanced. In addition, diagonally cutting the sealed part where the contents pouring-out implement 11 is attached prevents the contents pouring-out implement 11 from protruding from the corners of the container. Therefore, benefits are presented in that the container can be efficiently stacked during packaging and that packaging can be completed without extraneous open space being formed in a packing box.

Figure 6:
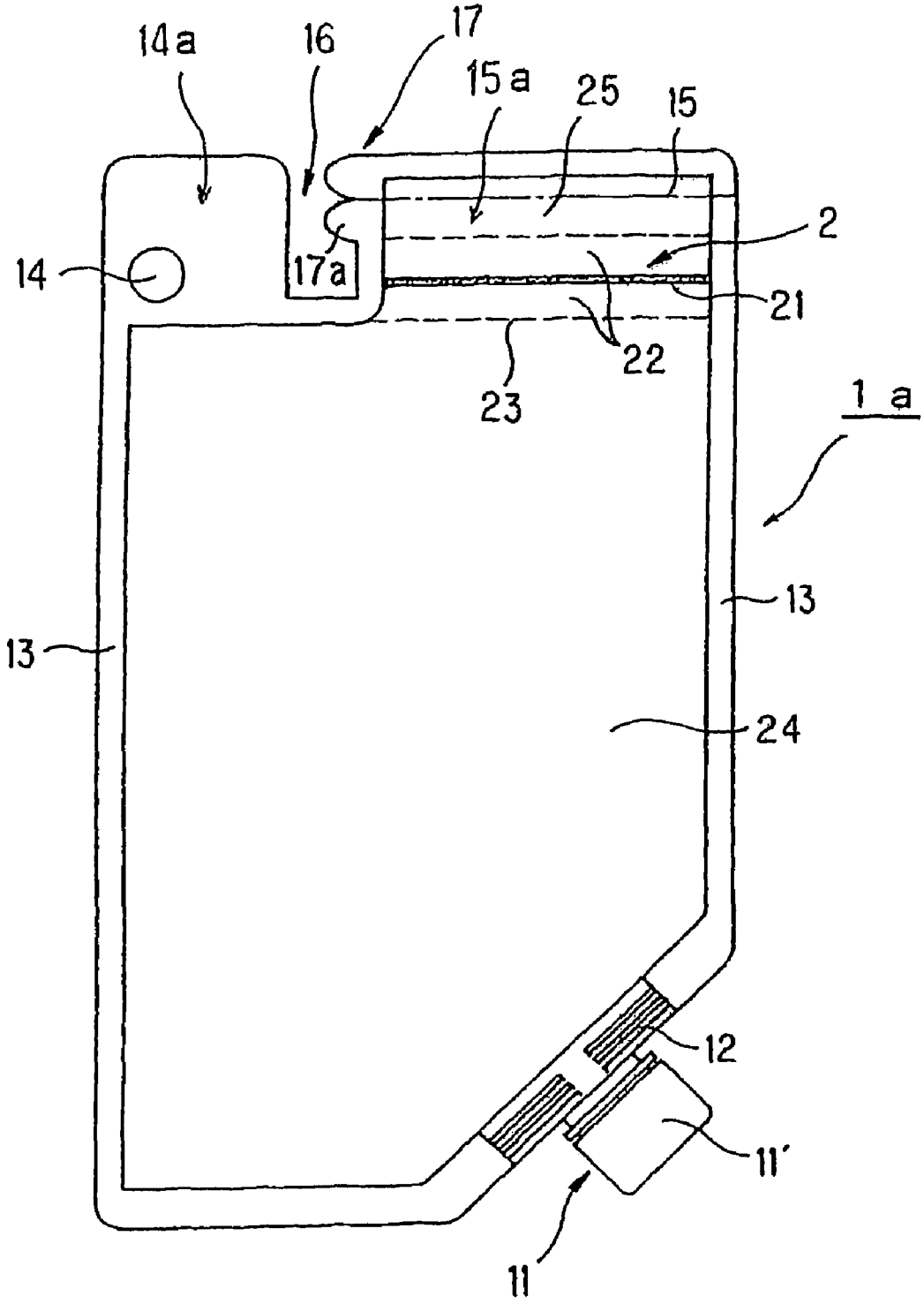

The mode of FIG. 6 is a modification of the mode of FIG. 3. In the mode, the width of the cut 16 is increased, and the inner end part of the predicted unsealing part 15 is a projecting part that is used as a flap 17. A central portion of a distal end of the flap 17 is matched in position with the predicted unsealing part 15, and the portion is formed into, e.g., a ϵ shape 17*a*. Accordingly, a benefit is presented in that the linear fastener 2 part is more stably unsealed. The flap 17*a* is left uncut after the predicted unsealing part 15 has been cut away using scissors or the like. Therefore, when water is added, the flap 17*a* is held by hand when the spout of the container is gripped, whereby the held container is less likely to slip and fall down and is more readily gripped.

Figure 7:
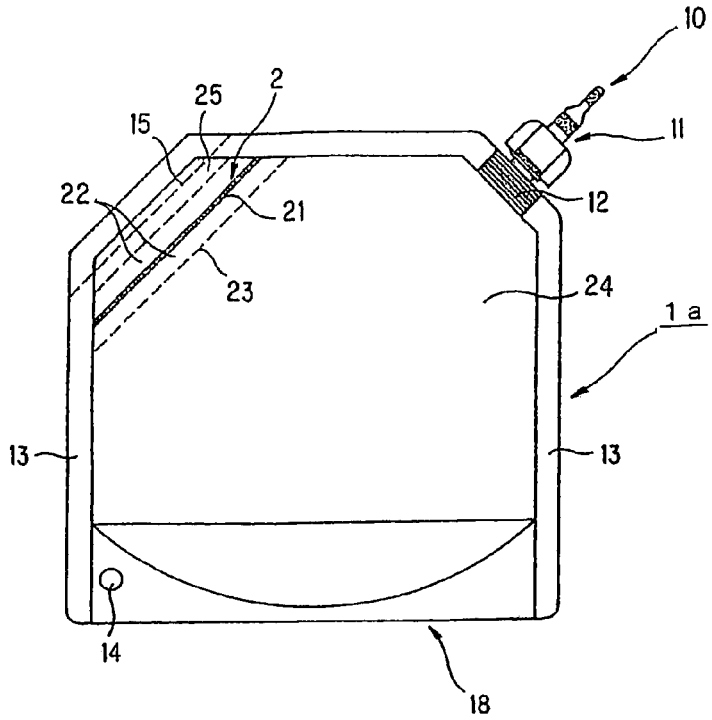

In the mode of FIG. 7, the bag-like container with a spout of the first invention can be used as a standing pouch. A side surface on the side opposite the side on which the contents pouring-out implement is attached is used as a bottomed part 18, whereby the container can be set down in a stable state before use.

<Second Invention>

It is an essential criterion that the second invention of the present application be a bag-like container with a spout in which a peripheral edge part of a body member formed from front and rear plastic films is sealed, and in which a contents spout is formed at a part of the peripheral edge part; comprising a suspending part that is formed on a side opposite the contents spout and that is suspended by a suspending implement; a supplying part that is adjacent to the suspending part and that forms a supply opening in accordance with the unsealing of a predicted unsealing part; a cut part formed between the suspending part and the supplying part; and a connecting part that is formed on in the cut part and that is used to partially connect the suspending part and the supplying part.

The second invention shall be described in terms of the modes shown in FIGS. 12 through 15.

Figure 12:
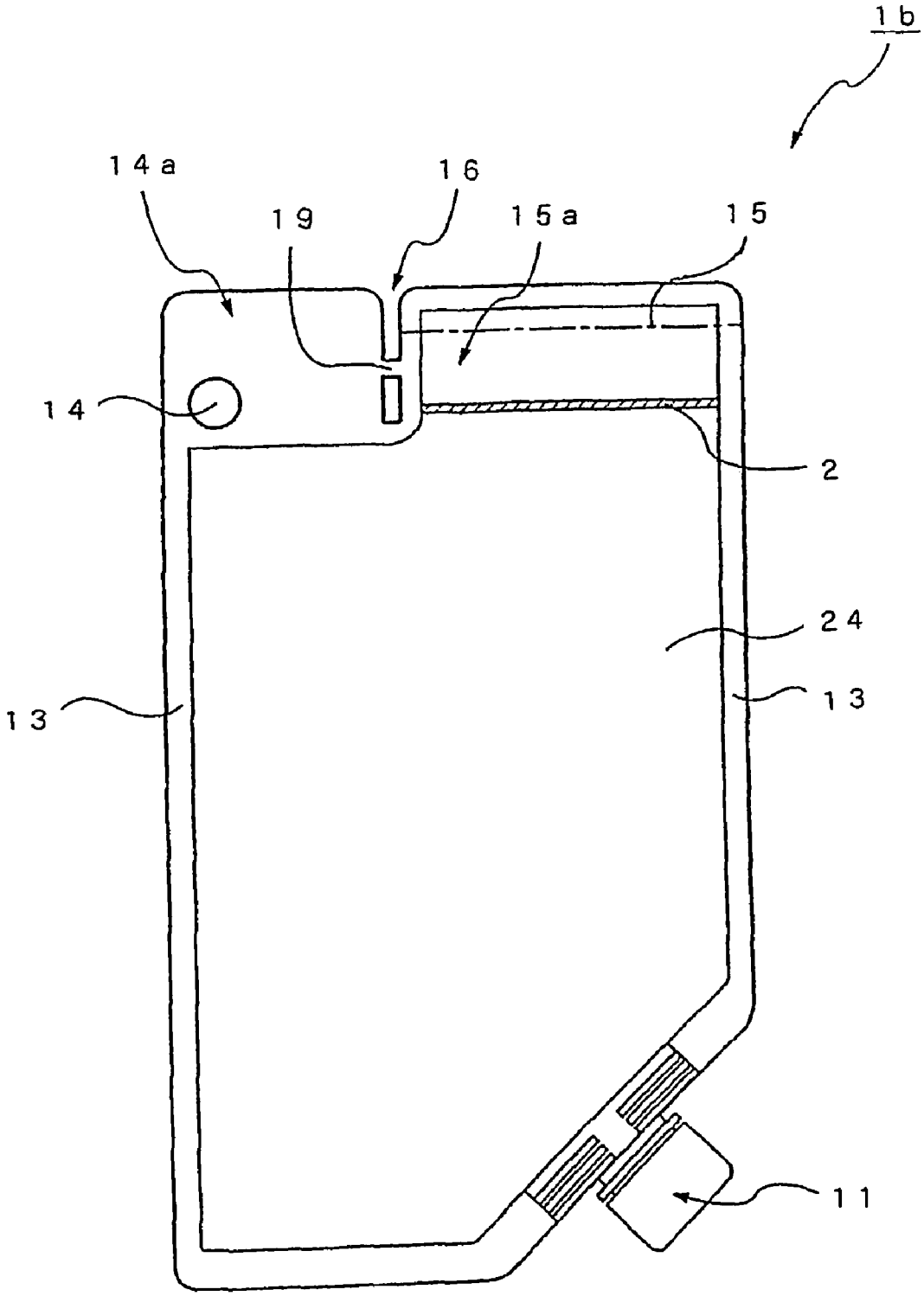
FIGS. 12 through 15 are front views showing preferred configurations of a bag-like container with a spout of a second invention of the present application.

The mode shown in FIG. 12 is similar in configuration to the bag-like container of the first invention shown in FIG. 3. It is a technological object of the second invention to resolve a problem that may arise in that, when the suspending part 14*a* and supplying part 15*a* are separated by the cut part 16, if the container falls or is packed in a box while in a vertically inverted orientation, the suspending part 14*a* and supplying part 15*a* will fold in different directions and split up the middle, wrinkling and splitting will occur at the base part of the fold, the commercial value will decrease in terms of outer appearance, and the original usability cannot be achieved when used, as shown in FIG. 3. Therefore, the second invention of the present application is most importantly characterized in comprising a connecting part 19 that partially connects the suspending part 14*a* and the supplying part 15*a*. When the connecting part is provided, even when the cut part 16 is situated between the suspending part 14*a* and the supplying part 15*a*, the suspending part 14*a* and supplying part 15*a* can be prevented from folding in different directions.

The connecting part 19 may be formed as a member separate from the bag-like container, but is preferably formed integrally with the bag-like container. For example, the connecting part 19 can be formed at the same time ✚ as the cut part✚ if the cut part 16 is die-cut and part of the cut part is left. The width and length of the connecting part 19 can suitably be set as desired as long as a level of strength can be ensured at which breakage will not occur under a normal load. The width and length of the connecting part are preferably set so that a suitable degree of freedom is ensured for the supplying part 15*a*, and so that the suspending part 14*a* and supplying part 15*a* are kept in a connected state.

While the predicted unsealing part is being unsealed or after the predicted unsealing part has been unsealed, the connecting part 19 is cut, whereby the suspending part 14*a* and supplying part 15*a* can be separated. Therefore, the degree of freedom of the supplying part 15*a* increases after the predicted unsealing part is unsealed, and the supplying part 15*a* is more readily opened and closed. A notch, cut, perforation, unsealing groove, or the like is preferably provided to the connecting part 19 so the cut can be readily made by hand. In this instance, the notch or cut is preferably provided only to a lower side of the connecting part 19 in order to prevent inadvertent breakage.

Another mode of the second invention shall next be described with reference to FIG. 13.

Figure 13:
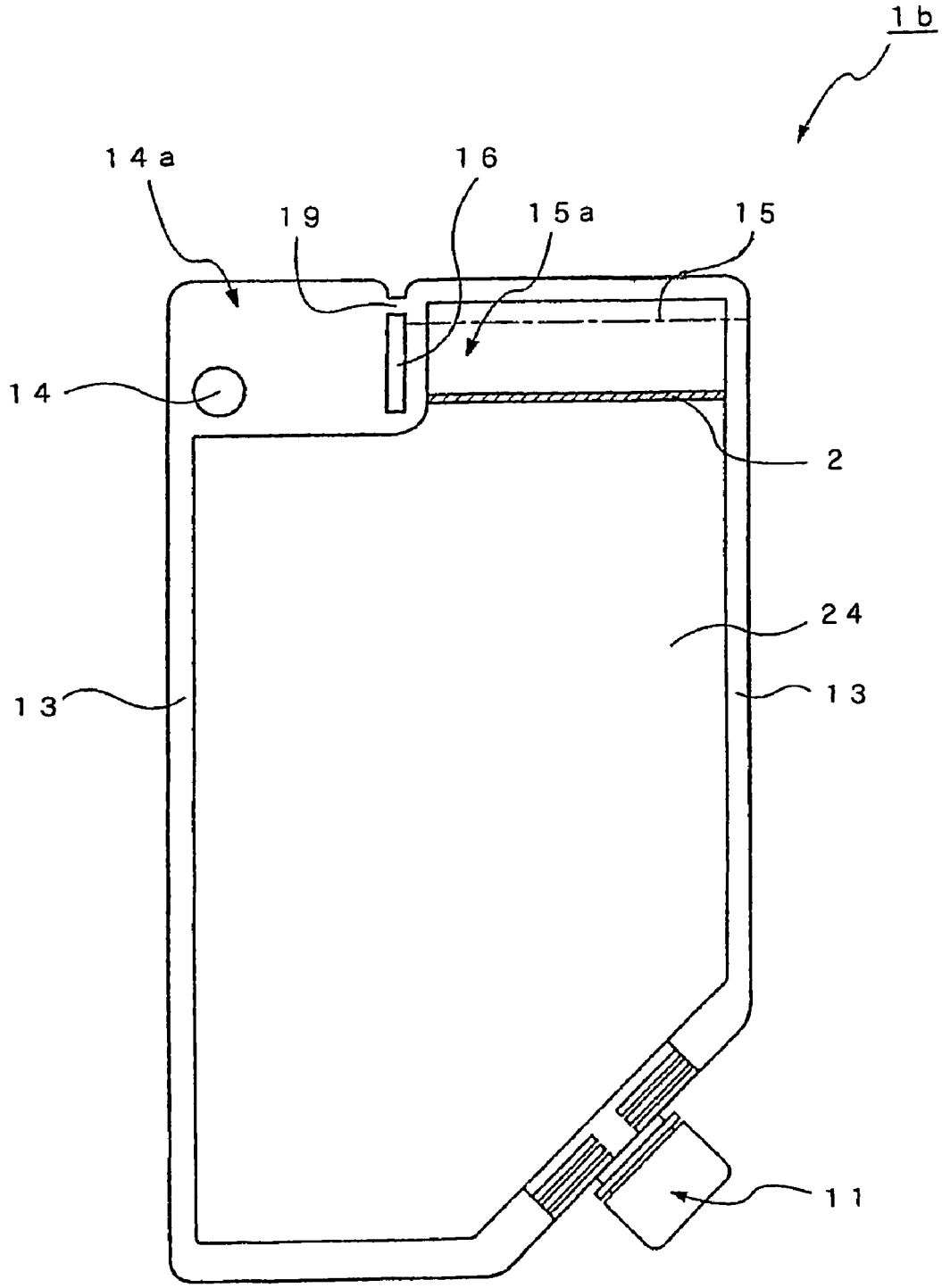

In this mode, the predicted unsealing part 15 is connected to the suspending part 14*a* through the connecting part 19, and the connecting part 19 is separated from the supplying part 15*a* in accordance with the unsealing of the predicted unsealing part 15, as shown in FIG. 13.

Such a configuration enables the unsealed predicted unsealing part 15 to be supported by the suspending part 14*a* without being separated from the bag-like container 1*b*. Therefore, the unsealed predicted unsealing part 15 and the main body of the bag-like container 1*b* need not be disposed of separately, and the usability of the bag-like container 1*b* can be improved. In addition, before the predicted unsealing part 15 is unsealed, the suspending part 14*a* and supplying part 15*a* are connected; and, after the predicted unsealing part 15 is unsealed, the suspending part 14*a* and supplying part 15*a* are separated. Therefore, the degree of freedom of the supplying part 15*a* can be increased after the predicted unsealing part has been unsealed, and the supplying opening can more readily be opened and closed.

Figure 14:
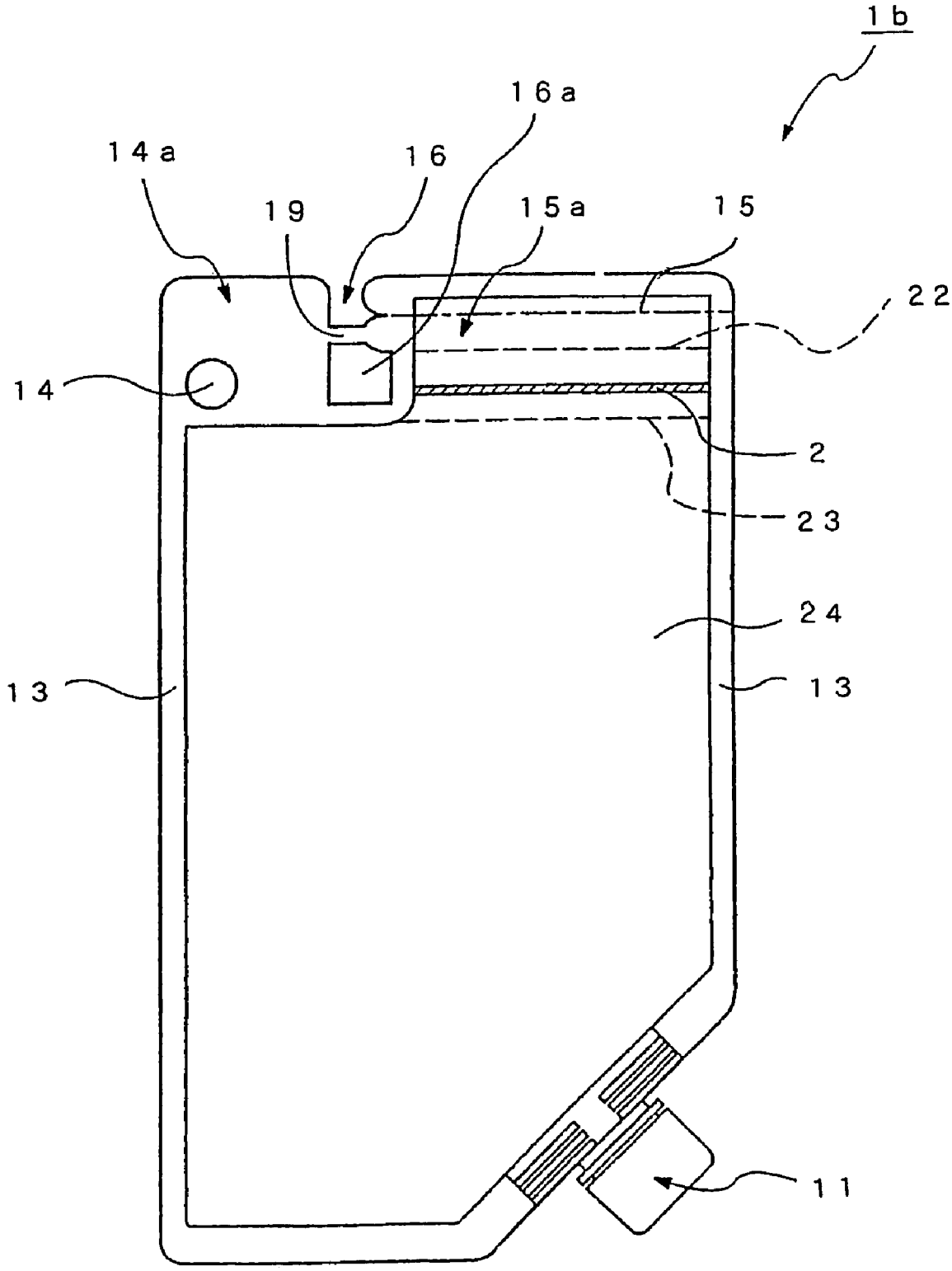

In the second invention as well, the linear fastener 2 can be used in the bag-like container 1*b* to function as a contents blocking member in a manner similar to in the first invention, as shown in FIG. 14. The positioning and operation of the linear fastener 2 of the bag-like container 1*b* are the same as in the first invention. Therefore, symbols are assigned in the drawings, and descriptions thereof shall be omitted. In FIG. 14, the width of the cut part 16 is increased and the cut part can be configured as a hole 16*a* into which a finger can fit. The hole 16*a* may be substantially rectangular, but can also be circular. The connecting 19 part may be cut when the container is unsealed. Since a finger enters the hole 16*a*, no hindrance is posed to the opening and closing of the supplying part 15*a* even if the connecting part is not cut.

Figure 15:
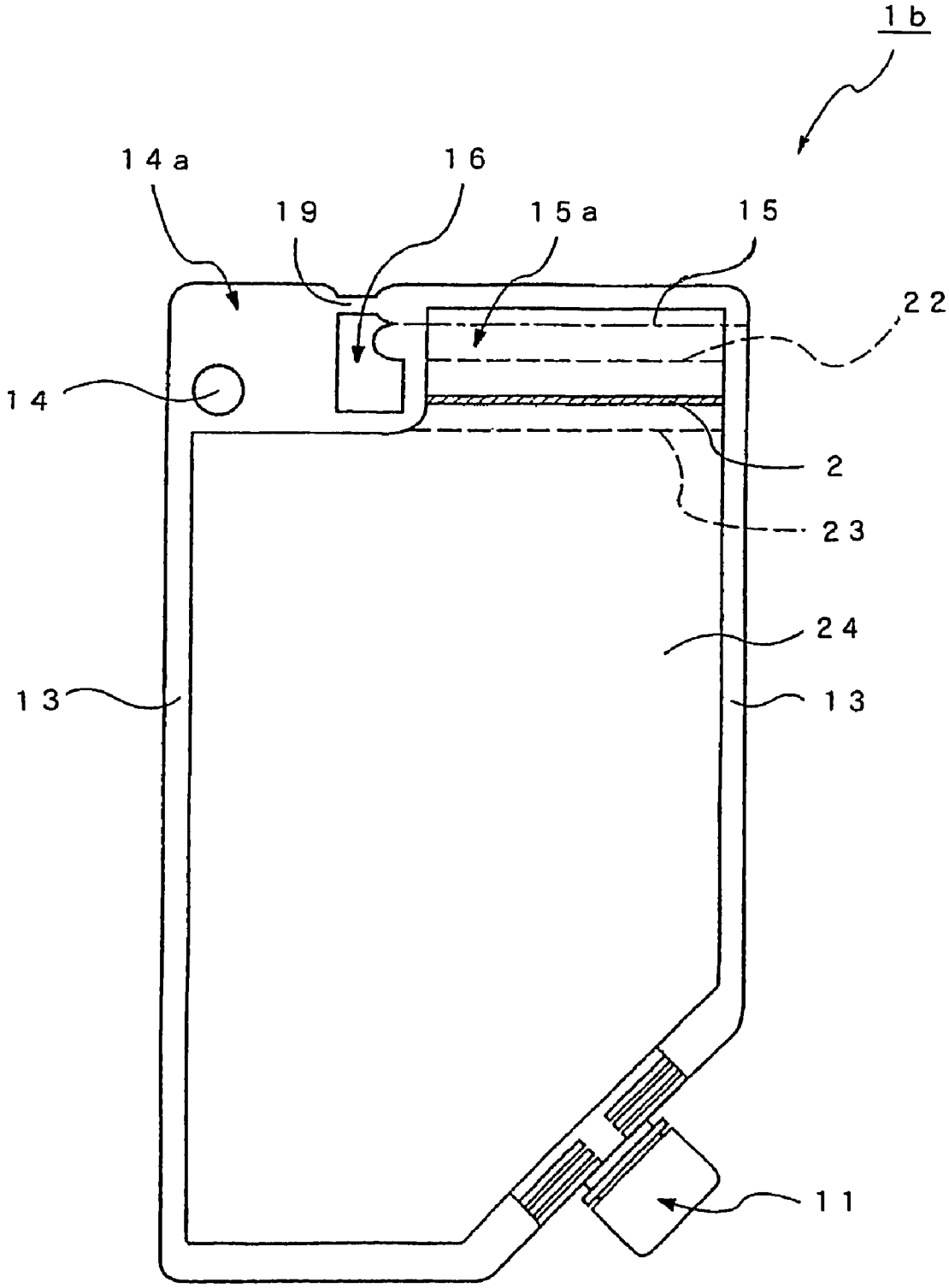

Another aspect of the second invention shall next be described with reference to FIG. 15.

In this aspect, the predicted unsealing part 15 is connected to the suspending part 14*a* through the connecting part 19, and the connecting part 19 is separated from the supplying part 15*a* in accordance with the unsealing of the predicted unsealing part 15.

Such a configuration enables the unsealed predicted unsealing part 15 to be supported by the suspending part 14*a* without being separated from the bag-like container 1*b*. Therefore, the unsealed predicted unsealing part 15 and the main body of the bag-like container 1*b* need not be disposed of separately, and the usability of the bag-like container 1*b* can be improved.

<Third Invention>

Figure 16:
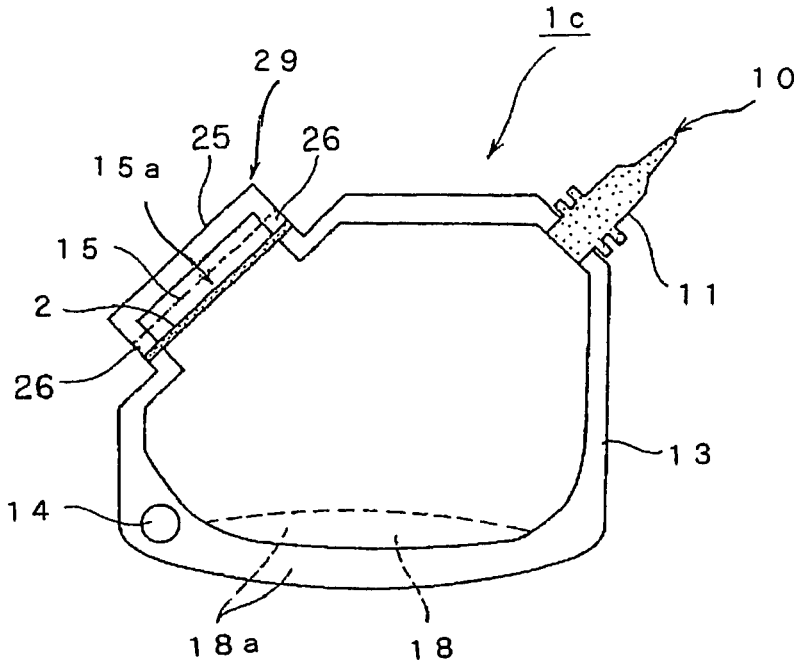
FIGS. 16 through 23 are front views showing preferred configurations of a bag-like container with a spout of a third invention of the present application.
Figure 23:
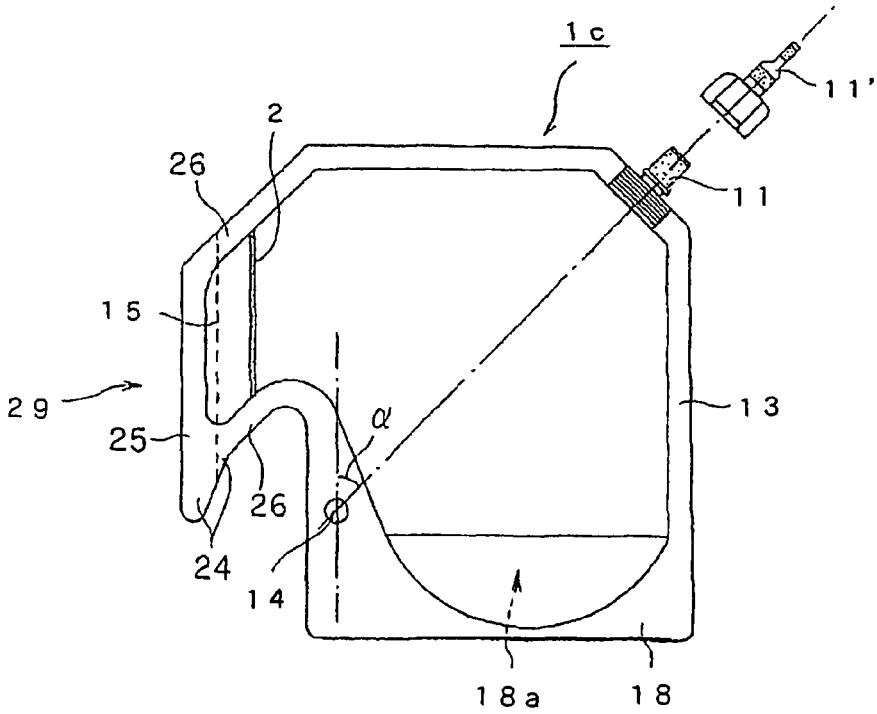
Figure 24:
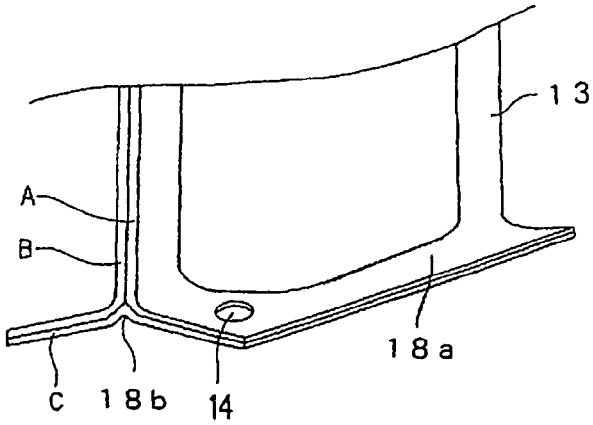
FIG. 24 is an enlarged perspective view showing a structure of a bottom part of the bag-like container with a spout.
Figure 25:
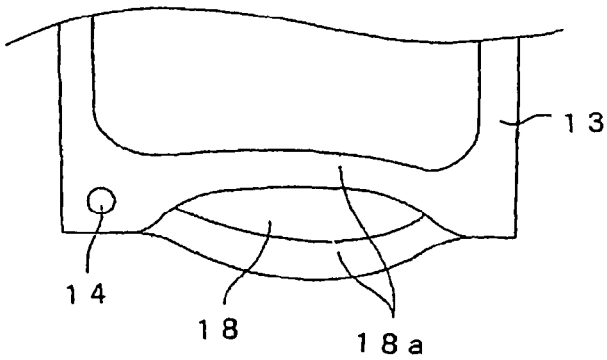
FIG. 25 is a perspective view showing a structure of another bottom part.
Figure 26:
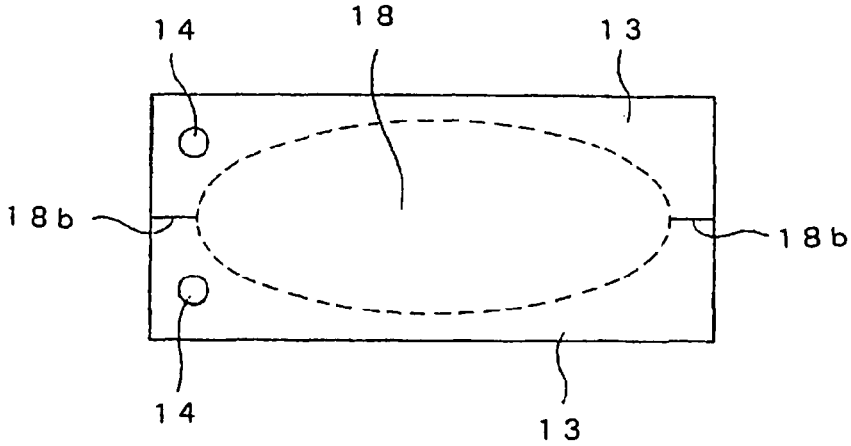
FIG. 26 is a bottom view of the structure of a bottom part of FIG. 24.
Figure 27:
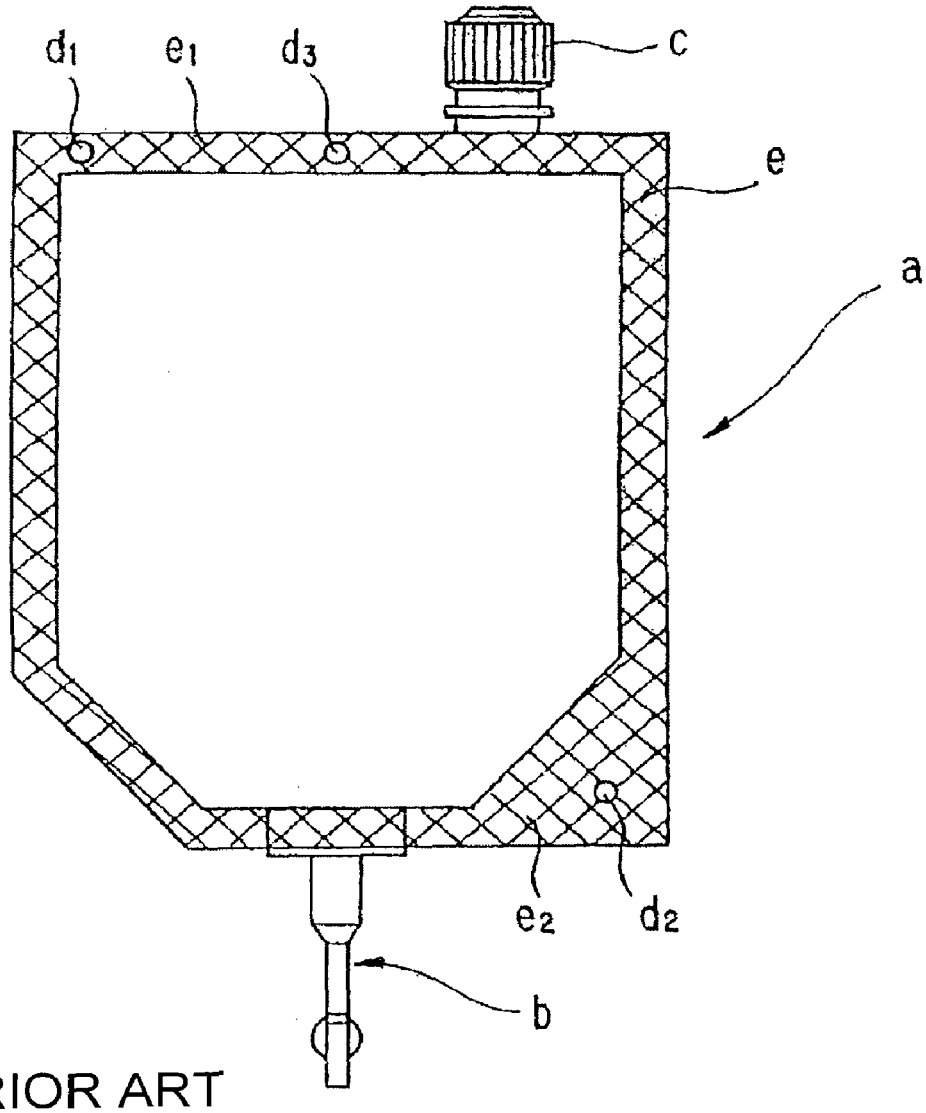
FIG. 27 is a front view of a conventional pouch for liquid food disclosed in Prior Art Document 1.
Figure 28:
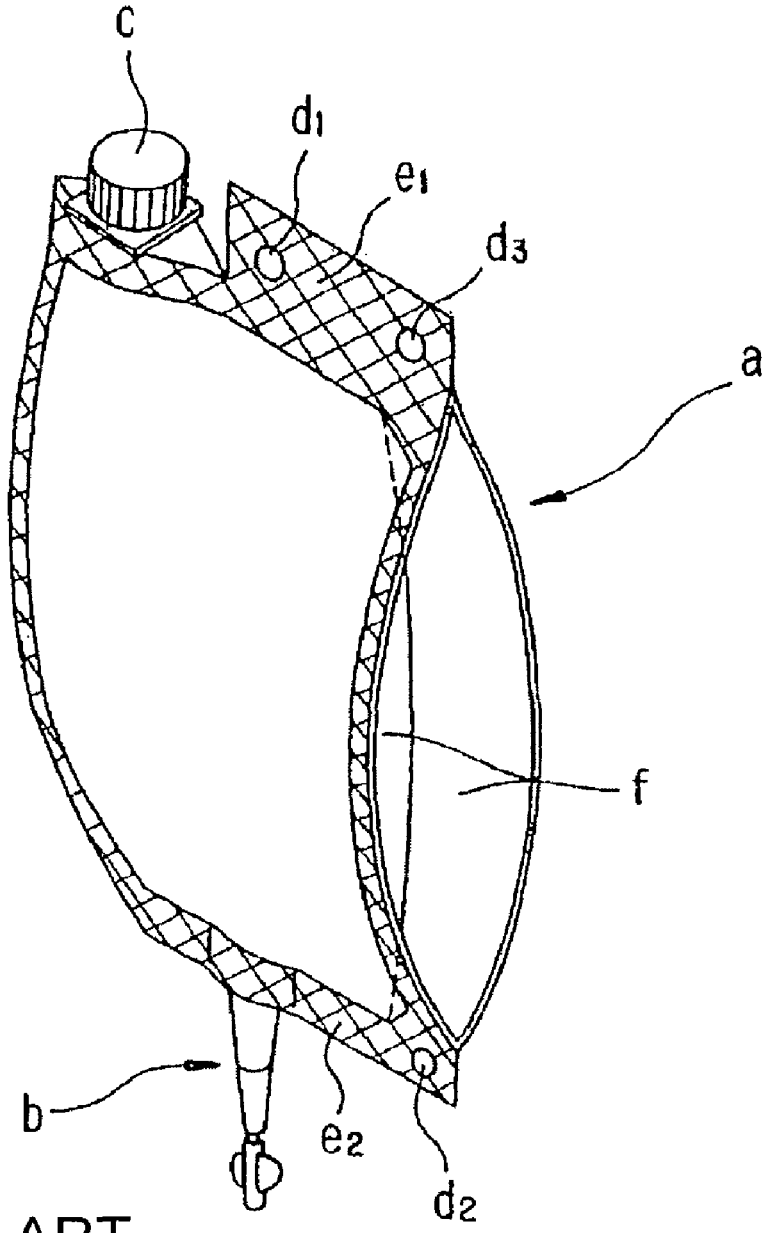
FIG. 28 is a perspective view of a conventional pouch for liquid food disclosed in Prior Art Document 2.
Figure 29:
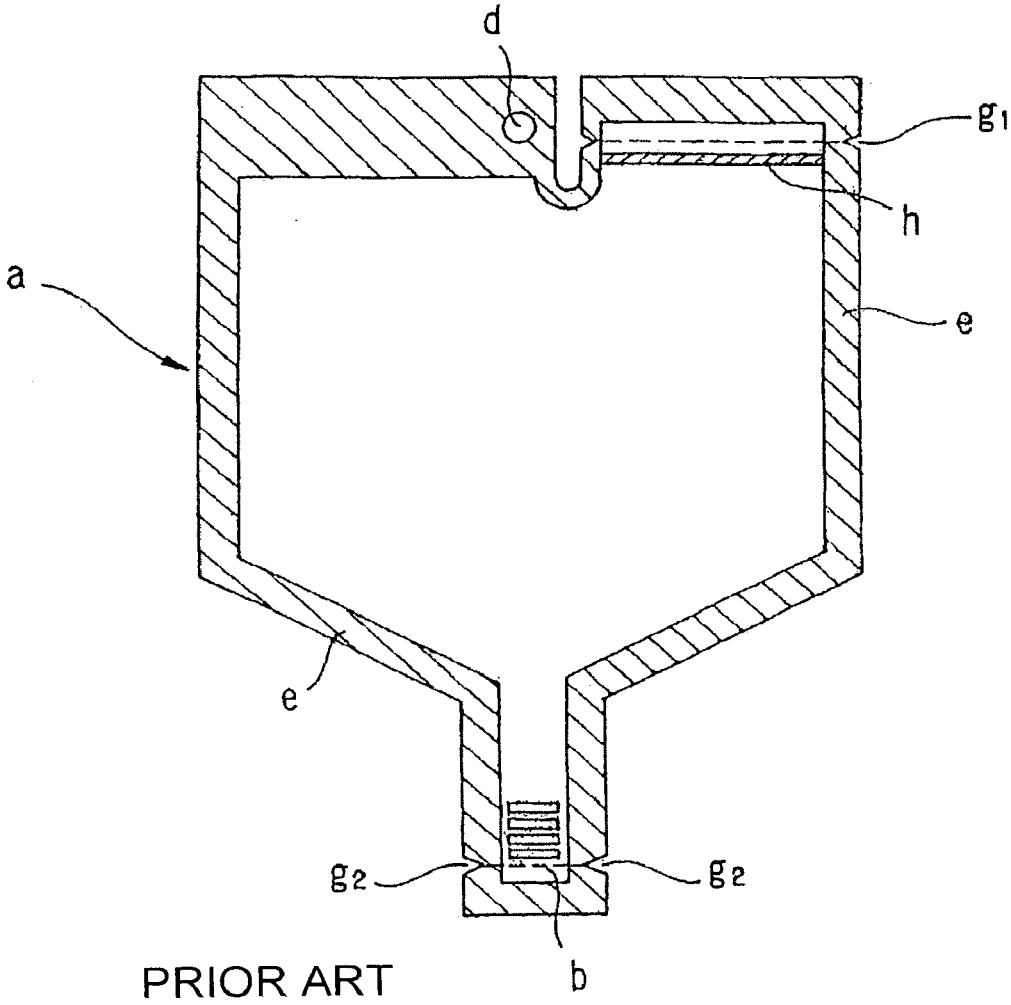
FIG. 29 is a front view of a conventional pouch for liquid food disclosed in Prior Art Document 3.

FIG. 16 is a front view showing an embodiment of a bag-like container with a spout 1*c* of the present invention. FIGS. 17 through 23 are front views showing other embodiments. FIG. 24 is an enlarged perspective view showing a layer configuration of a bottom part of the bag-like container with a spout 1*c* of the present invention. FIG. 25 is a perspective view showing another embodiment of the bottom part. FIG. 26 is a bottom view of FIG. 24.

Generally speaking, in the bag-like container with a spout 1*c* of the present invention, peripheral edge parts 13 of a plurality (usually three) of polygonal plastic films forming a front surface A, rear surface B, and bottom surface C are sealed; and the contents pouring-out implement (spout) 11 is attached to part of the peripheral edge part. The bag-like container with a spout is characterized in that a gripping part 29 is formed on the peripheral edge part of the pouch apart from the contents pouring-out implement 11; and the plastic linear fastener 2 is attached at a location apart from an outer-end sealed part 25 in the gripping part toward the inside of the container in a state of traversing the gripping part 29. The seal is usually formed by heat sealing, but may also be formed by ultrasonic waves.

The shape of the bag-like container with a spout 1*c* of the present invention is suitably set with consideration given to facility of use. However, the container is often formed into an irregular polygonal shape, with a quadrangular shape being the basic shape, due to the gripping part 29 being formed. Corner parts of the polygonal shape need not be sharply angular, and a shape may be adopted in which the straight lines are connected by a curved line. Any shape may be used as long as the shape is approximately polygonal when viewed as a whole. In the present invention as well, the plastic film constituting the body of the bag-like container with a spout 1*c* is preferably transparent so that the condition of the administration of the contents can be checked from the outside. The plastic film may be a singular film. However, a composite film having two or more layers is normally used.

The plastic film is configured in the manner described in the first invention.

No particular limitation is placed on the shape of the gripping part 29. However, the gripping part is grasped using one hand while water is added from the supplying part 15*a*, and the open part can be readily opened by being gently twisted. Therefore, the grasping part preferably has a part that protrudes enough to enable the gripping part to be grasped with the fingers or a single hand. It is preferable that a flap 24 be provided to, or a finger access part 27 be formed on, at least one side-end sealed part 26 of the gripping part 29 in order to improve the ability of a distal end part of the grasping part 29 to enable the distal end part of the gripping part 29 to be more securely gripped while water is added (see FIGS. 18 and 21 through 23). The flap 24 and finger access part 27 are used to prevent the container from slipping and falling when the gripping part 29 is gripped and raised, and are formed on one or both end parts of the side-end sealed part 26. No particular limitation is placed on the shapes of the flap and finger access part as long as the flap and finger access part can be grasped with the hand.

The predicted unsealing part 15, which is a location where a tear is made when the container is unsealed, is provided between the linear fastener 2 and the outer-end sealed part 25 of the gripping part 29. Specifically, for example, a dotted line indicating the predicted unsealing part may be printed on the predicted unsealing part 15. A notch may be made at the end part to facilitate the process of starting the tear. When there is provided a brittle line or another easy-unsealing mechanism created by scoring or laser processing, the container can be torn merely with the hands when a scissors or another cutting implement is not used, which is preferable. When the flap 24 is provided to the side-end sealed part 26, the flap 24 must be provided so that at least part of the flap 24 is positioned nearer to the linear fastener 2 than the predicted unsealing part (see FIG. 18).

The linear fastener 2 used in the present invention is as already described in the first invention. As described above, the weakened part of the linear fastener 2 is configured not to break when the contents are in the pouch, and to break following the unsealing of the linear fastener.

The bag-like container with a spout of the present invention has a bottomed structure in which peripheral edge parts of three films usually composed of a front surface film A, rear surface film B, and a bottom surface film C are heat sealed. FIG. 26 is a bottom view of this state. The films composed of A, B, and C can be heat sealed in various configurations, as shown in FIGS. 24 through 26. A configuration may be adopted in which lower parts of A, B, and C spread in two directions from a sealing contact part 18*a*, as shown in FIG. 24. The bottom part 18 may also be configured so that the edge parts on both sides are heat sealed to a ground surface without spreading in two directions, and only a central portion is set apart from the ground surface, as shown in FIG. 25. The heat sealed part 18*a* of the bottom part is indicated by 18*a*. In either instance, the container with a pouring-out implement can be placed in a self-sustainable state, and can be arranged in an orderly fashion without adversely affecting the transport/storage of several bag-like containers with a spout.

The contents pouring-out implement 11 and gripping part 29 should be positioned so as to be separated with a gap formed therebetween that enables the gripping part 29 to be grasped by the fingers or one hand. The contents pouring-out implement and gripping part may be formed on the same side surface or may be formed on mutually opposite sides. When the bottom part 18 is oriented downward and the container stands unassistedly, the contents pouring-out implement 11 and gripping part 29 are preferably positioned above the bottom part 18, as shown in FIGS. 16 through 23. However, the configuration is not limited thereto.

Figure 17:
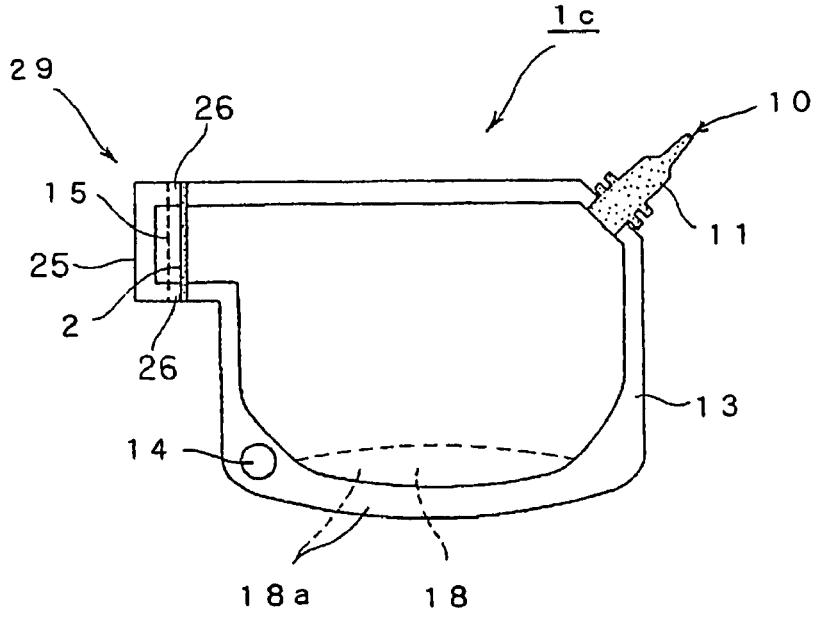
Figure 18:
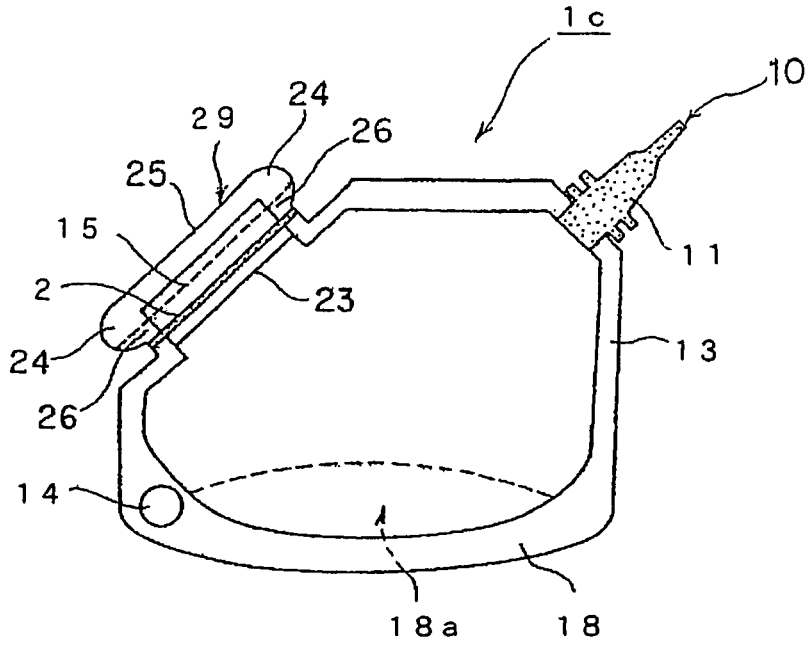
Figure 19:
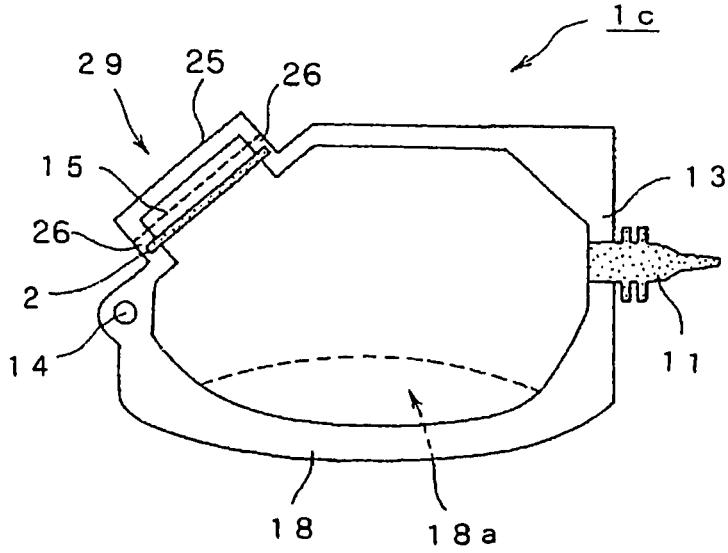

In the body part of the container that is basically substantially quadrangular in shape in the embodiment of FIG. 16, a diagonal part is provided to a corner part at a top edge and one side edge when the container stands unassistedly, the contents pouring-out implement 11 is attached, the gripping part 29 is provided to the diagonal part of the other corner, and a hole is formed in the sealed part at the bottom part at the corner opposite the contents pouring-out implement 11 and used as the suspending means 14. FIG. 18 shows an example in which the flap 24 is further provided to the side edge 26 of the gripping part of the same container as in FIG. 16. FIG. 17 shows an example in which the gripping part 29 is provided to a side edge of the container instead of a corner part. FIG. 19 shows an example in which the gripping part 29 is formed on the corner part and the contents pouring-out implement 11 is attached to the side edge on the opposite side.

Figure 20:
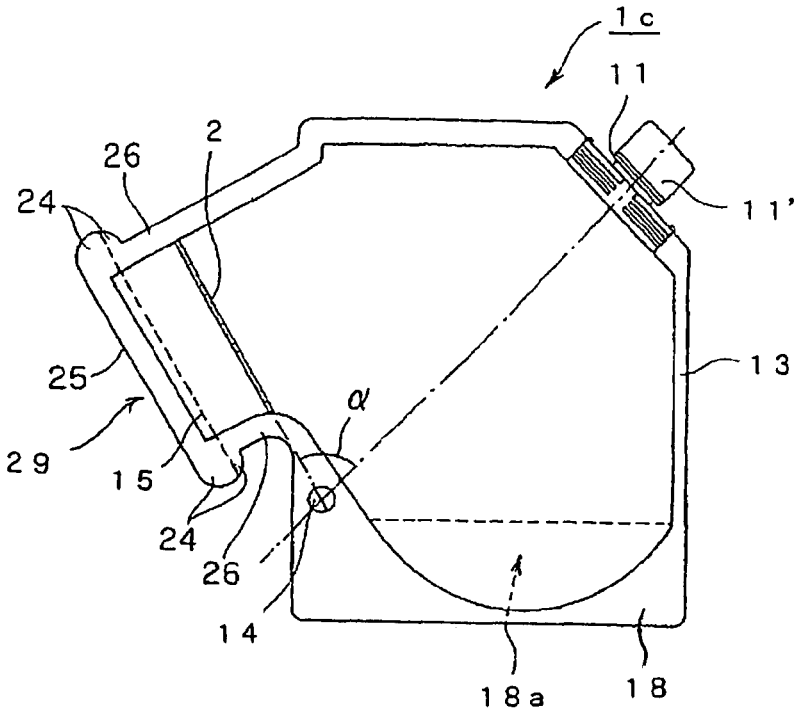
Figure 21:
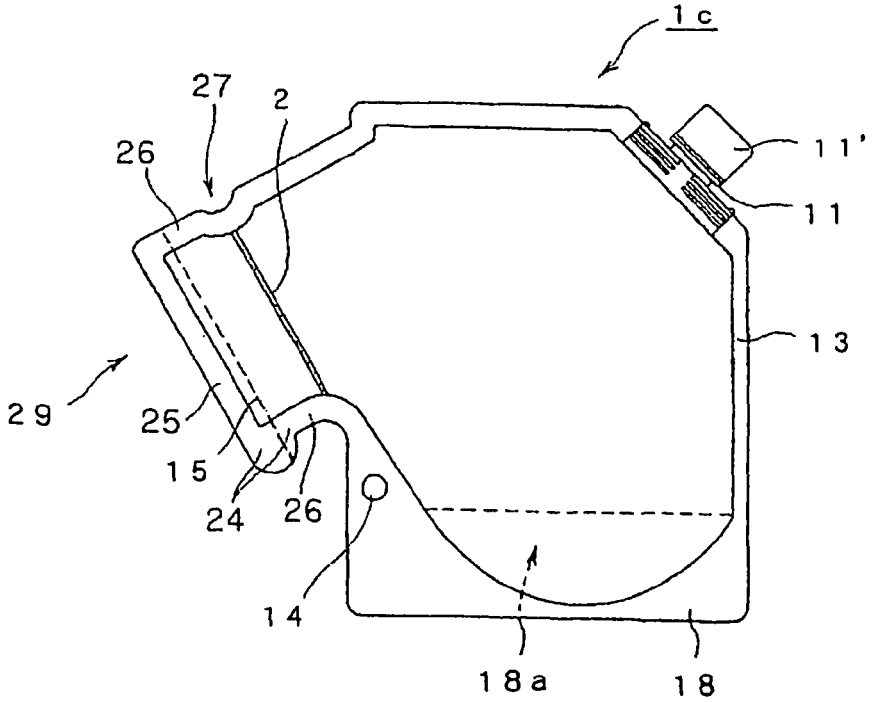
Figure 22:
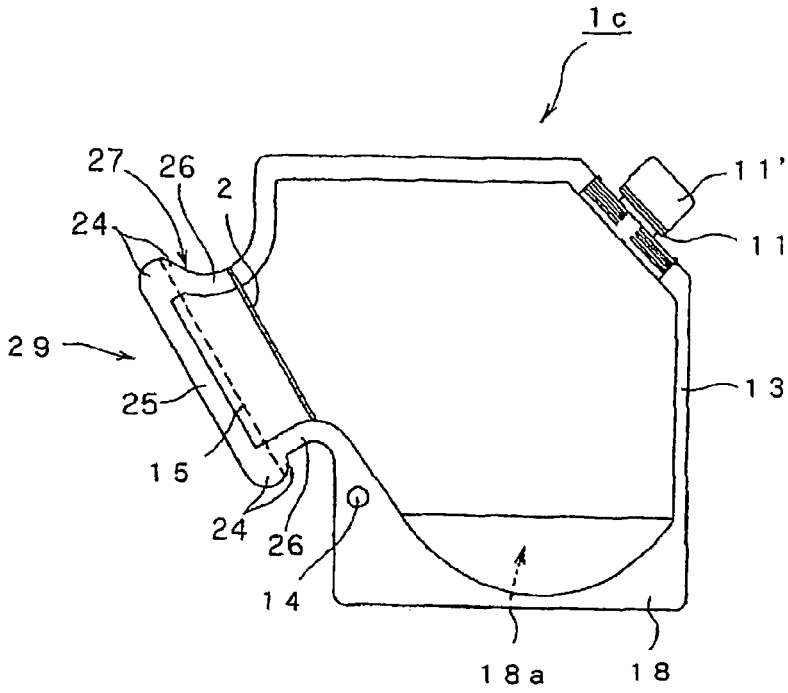

FIGS. 20 through 22 show instances in which the contents pouring-out implement 11 is provided to the corner part at the upper edge of the container when the bottom surface 18 is oriented downward and the container stands unassistedly, and the gripping part 29 protrudes diagonally downward from the side edge of the container on the side opposite the contents pouring-out implement. The suspending means (hole) 14 is provided near the corner part of the opposite sealed part 18*a* of the bottom part of the container. In these examples, an angle ($\alpha$ in FIG. 20) formed by a line segment connecting a center of the spout and a center of the suspending means and a line parallel to the engaging projecting part and recessed part of the linear fastener 2 that traverses the gripping part 29 is in a range of 45 to 110° ($\alpha$=about 75° in FIG. 20). Therefore, the linear fastener 2 is in a horizontal or a somewhat inclined position when the container is hung, and the opening of the fastener faces upward or diagonally upward. Therefore, water or the like can readily be poured from the linear fastener 2, which is preferable. FIG. 23 shows an example in which $\alpha$ is about 45°.

The configuration of the present invention was described in detail above. However, in all the inventions, the same configuration as described in the first invention can be used for the material of the film constituting the container and the pouring-out implement constituting the linear fastener and spout.

EFFECT OF THE INVENTION

According to the present invention, a specific plastic linear fastener is provided as a spout for diluting the contents, supplying water after the contents have been administered, and for washing a retaining line after the container has been used. The plastic linear fastener is provided to a position set apart from a contents spout in a liquid food container or another bag-like container with a spout. Accordingly, a hard separate filling implement is not specially attached to the container, as in the prior art, and a liquid food container or other bag-like container with a spout is provided in which the above-described objects can be sufficiently obtained using an uncomplicated configuration. The bag-like container with a spout provides a benefit in terms of cost in that the container can be provided as a one-way container. The present invention is superior to conventional liquid food containers in terms of sanitation in that a predicted unsealing part and contents are prevented from coming into contact before unsealing, and the opening is kept clean after unsealing.

When the specified linear fastener in which the films provided with the linear fastener are mutually connected through a weakened part, since the contents of the container do not adhere to the area around the engaging portion of the linear fastener when the contents of the container are sterilized, the ingress of foreign substances and contaminants can be prevented ahead of time, and the contents of the container can be administered to a subject in a clean manner.

When the unsealing weakened part is formed between the linear fastener and the outer-end sealed part of the gripping part, the container can be torn merely by the hands without the use of scissors or another cutting implement. Forming a flap or finger access part on the sealed part on the side edge of the gripping part is preferable in that the gripping part will be easier to grip and the container will be less likely to slip and fall.

When a cut part is formed between the suspending part and the supplying part, the suspending part and supplying part are partially connected, whereby the suspending part and supplying part are prevented from folding separately and bending in two directions, and corresponding wrinkling and splitting can be prevented.

Using the bag-like container with a spout of the present invention as a standing spout enables the container to be stably placed in a wagon or the like during transport or moving. In addition, the open part can be opened while the gripping part is held when an opening is to be formed to add water. Therefore, water or the like can stably and assuredly be poured into the container from a hose, pot, pitcher, or the like, and water can be added without instances of mistakes such as the clothes and bedding of the subject getting wet.

In the bag-like container with a spout of the present invention, when a diagonal part is provided to a corner at an upper edge and a side edge when the container is made independent and the contents pouring-out implement is attached to or the gripping part is formed on the diagonal part, the contents pouring-out implement and gripping part will not protrude from the corner part of the container. Therefore, ~~+~~ the container~~+~~ can be efficiently stacked during packaging, and packaging can be completed without extraneous open space being formed in a packing box.

INDUSTRIAL APPLICABILITY

As described in detail above, in the bag-like container with a spout of the present invention, when water content or the like is to be supplied after the contents have been administered, the water content can be supplied in a clean manner merely by using an implement for forming an opening in a predicted unsealing part using a linear fastener rather than by providing a separate pouring-in implement. The present invention is not only inexpensive, but also enables water to be reliably added, simplifies the process for forming the container, and allows widespread use as a one-way bag-like container with a spout.

The invention claimed is:

1. A bag-like container with a spout in which a peripheral edge part of a body member, formed from front and rear plastic films, is sealed, and in which a contents pouring implement is formed at a part of the peripheral edge part; the bag-like container with the spout comprising:

an openable and closeable plastic linear fastener including a linear projecting part and a recessed part that engages with the projecting part is fused between a predicted unsealing part and a container internal space on the inside of a container peripheral edge part set apart from the contents pouring implement;

the projecting part of the linear fastener is formed in one plastic film, and the recessed part is formed in another plastic film which faces the one film in which the projecting part is formed; and the projecting part and the recessed part of the linear fastener are blocked in a liquid-tight manner from the container internal space by a film having a weakened part;

suspending means is formed on at least the peripheral edge part of the container that faces the contents pouring implement;

a cut part is formed between the predicted unsealing part and the suspending means; and a connecting part that is formed in the cut part and that is used to partially connect the predicted unsealing part and the suspending means.

2. The bag-like container with a spout according to claim 1, wherein the film having the weakened part is a film-like base material to which the linear fastener is provided.

3. The bag-like container with a spout according to claim 2, wherein fusing the linear fastener to the body member of the container includes fusing the linear fastener along the linear projecting part and recessed part provided to the film-like base material, and not fusing the linear fastener with the film-like base material on the side having the weakened part.

4. The bag-like container with a spout according to any one of claims 1 through 3, wherein each of said plastic films, constituting the body member of the container, is a laminate film.

5. The bag-like container with a spout according to claim 1, wherein the weakened part of the linear fastener can break after the linear fastener disengages.

6. The bag-like container with a spout according to claim 1, wherein the connecting part is separated from the predicted unsealing part in accordance with the unsealing of the predicted unsealing part.

7. The bag-like container with a spout according to claim 1, wherein the bag-like container is bottomed.

8. The bag-like container with a spout according to claim 7, wherein a diagonal part is provided to a corner of an upper edge and side edge of the container when the bottom surface of the bag-like container is oriented downward and the container stands unassistedly, a contents pouring implement is attached to the diagonal part, and a gripping part is formed on the side edge and a correspondingly opposite side edge.

9. The bag-like container with a spout according to claim 7, wherein a diagonal part is provided to a corner of an upper edge and side edge of the container when the bottom surface of the bag-like container is oriented downward and the container stands unassistedly, a gripping part is formed on the diagonal part, and the contents pouring implement is attached on the side edge and a correspondingly opposite side edge.

10. The bottomed bag-like container with a spout according to claim 8 or 9, wherein a flap is provided to at least one of the side-end sealed parts of the gripping part.

11. The bottomed bag-like container with a spout according to claim 10, wherein a finger access part is formed on at least one of the side-end sealed parts of the gripping part.

12. The bag-like container with a spout according to claim 7, wherein diagonal parts are provided to both sides of an upper edge and side edge of the container when the bottom surface of the bag-like container is oriented downward and the container stands unassistedly, the contents pouring implement is attached to one of the diagonal parts, and a gripping part is formed in the other of the diagonal parts.

13. The bag-like container with a spout according to claim 1, wherein an angle formed by a line segment connecting a center of the spout of the contents pouring implement and a center of the suspending means and a line parallel to the linear fastener is between 45 and 110°.

14. The bag-like container with a spout according to claim 1, wherein an unsealing weakened part is formed between the linear fastener and an outer end sealing part.

* * * * *